US006355009B1

(12) United States Patent
Henkin et al.

(10) Patent No.: US 6,355,009 B1
(45) **Date of Patent: *Mar. 12, 2002**

(54) WATER POWERED MASSAGE APPARATUS WITH SLACK MEMBRANE

(76) Inventors: Melvyn Lane Henkin, 1001 Sharon La., Ventura, CA (US) 93003; Jordan Myron Laby, 1389 Beachmont, Ventura, CA (US) 93001

( * ) Notice: Subject to any disclaimer, the term of this patent is extended or adjusted under 35 U.S.C. 154(b) by 0 days.

This patent is subject to a terminal disclaimer.

(21) Appl. No.: 09/139,383

(22) Filed: Aug. 23, 1998

Related U.S. Application Data

(63) Continuation-in-part of application No. 08/200,472, filed on Feb. 23, 1994, now Pat. No. 5,820,574.

(51) Int. Cl.[7] ..... A61H 9/00

(52) U.S. Cl. ..... 601/155; 601/160; 601/169; 239/436; 239/461

(58) Field of Search ..... 601/154, 155, 601/156, 158, 159, 160, 161, 168, 169; 239/436, 438, 443, 461, 462

(56) References Cited

U.S. PATENT DOCUMENTS 4,640,462 A * 2/1987 Stearns ..... 601/160
4,926,510 A * 5/1990 Watkins ..... 601/148
5,820,574 A * 10/1998 Henkin et al. ..... 601/160

* cited by examiner

*Primary Examiner*—Michael A. Brown
*Assistant Examiner*—Benjamin K. Koo
(74) *Attorney, Agent, or Firm*—Freilich, Hornbaker & Rosen

(57) ABSTRACT

An apparatus for discharging a water stream for massaging a user's body characterized by a flexible limp slack membrane, preferably of terry cloth, mounted in front of a discharge orifice. In use, a water stream discharged from the orifice impacts against the rear face of the membrane while the membrane's front face is held against and massages the user's body. The kinetic energy of the stream deforms the limp, slack membrane and transfers through the membrane to provide a pleasing massage effect while minimizing the amount of unwanted splash. The apparatus may also include a continuous and/or pulsed shower outlet for selectively discharging a shower spray.

7 Claims, 20 Drawing Sheets

108
111
106
107
109
48
110
40

534
30
70
522
32
26
28
20
22
69
96
47
93
92
95
94
48
40
64
57
50
54
52
53
56
55
66
49
98
76
78
45
80
43
68
46
44
42
60
30

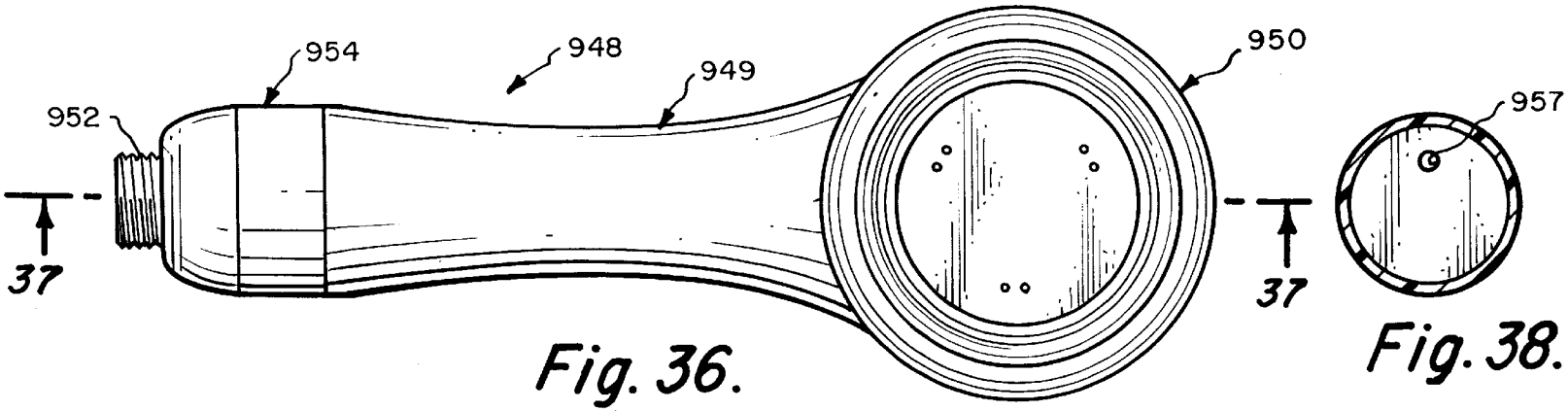
Fig. 36.
Fig. 38.
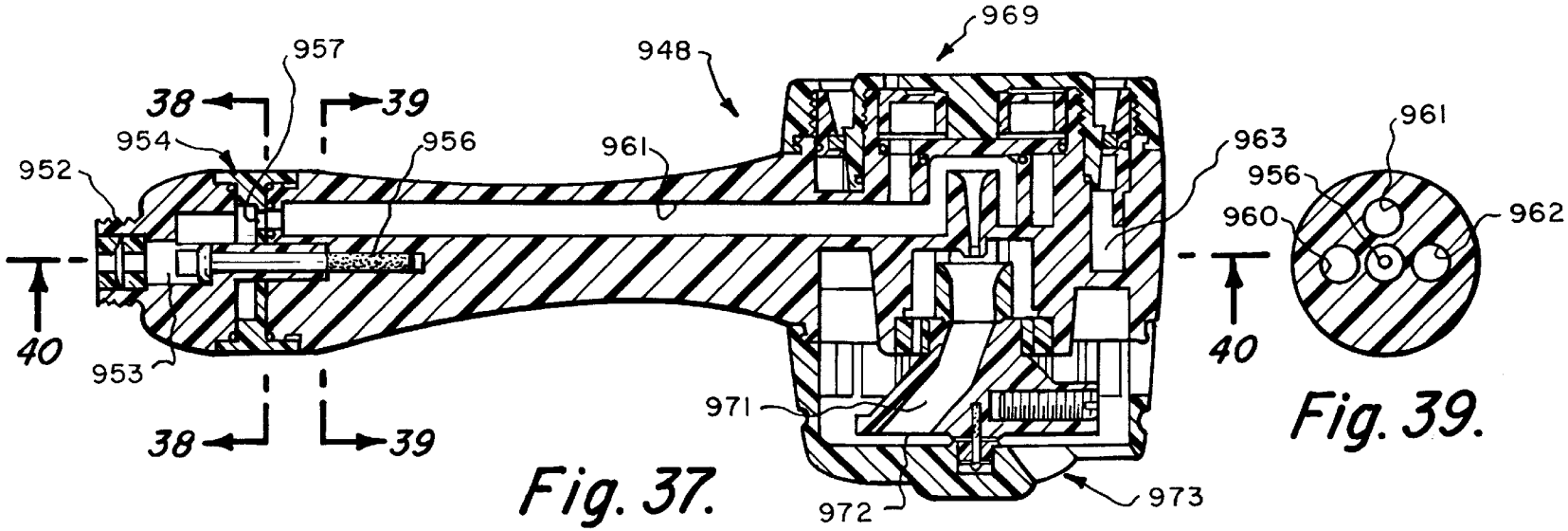
Fig. 37.
Fig. 39.

WATER POWERED MASSAGE APPARATUS WITH SLACK MEMBRANE

RELATED APPLICATIONS

This application is a CIP of parent application Ser. No. 08/200,472 filed Feb. 23, 1994, now U.S. Pat. No. 5,820,574, whose disclosure is by reference incorporated herein.

FIELD OF THE INVENTION

This invention relates primarily to apparatus useful in combination with utility supplied tap water for discharging a water stream for massaging a user's body.

BACKGROUND OF THE INVENTION

Many different devices are known in the art which utilize a water flow to massage a user's body, either by direct impact or by energy transfer through an intermediate membrane. In other devices, the water flow is used to vibrate or rotate a pad or brush which contacts the user's body. Exemplary prior art is cited in said parent application and additionally is described in the following exemplary U.S. patents:

| |
|---|
| 3,902,529 |
| 4,458,676 |
| 4,640,462 |
| 4,703,536 |
| 4,839,930 |
| 4,926,510 |
| 4,930,699 |
| 4,953,240 |
| 5,070,552 |
| 5,187,827 |

Still other devices for discharging water streams for massaging a user's body are disclosed in Applicants' following U.S. patents and the references cited therein:

| |
|---|
| 4,679,258 |
| 4,689,839 |
| 4,692,950 |
| 4,715,071 |
| 4,726,080 |
| 4,727,605 |
| 4,731,887 |
| 4,763,367 |
| 4,813,086 |
| 4,825,854 |
| 4,965,893 |
| 4,982,459 |
| 5,197,459 |
| 5,230,106 |
| 5,634,888 |
| 5,738,638 |

Applicants' aforelisted patents, whose disclosures are by reference incorporated herein, variously disclose both electric pump powered and tap water powered devices for discharging a hydromassage stream through a discharge orifice. Some of the disclosed devices are configured so that the discharge orifice travels along a defined or random path, driven along the path by energy derived from the discharged stream.

Applicant's grandparent application Ser. No. 08/048,356, now U.S. Pat. No. 5,634,888, describes a hand held apparatus particularly configured to operate from supplied tap water (typically, ≧20 pounds per square inch (p.s.i.)) at a low flow rate (typically, ≦3.0 gallons per minute (g.p.m.)) to propel a discharge orifice along a travel path while discharging a water stream of sufficient intensity to impact a user's body to provide a pleasing massage. A preferred embodiment of the apparatus is characterized by a handle housing and a head housing mounted for relative movement with respect to one another for operating an internal mode selector valve. The selector valve directs the supplied tap water to either a hydromassage outlet or a shower spray outlet. The stream discharged from the hydromassage outlet impacts (1) against the rear face of a removable flexible membrane whose front face is held against the user's body, or (2) with the membrane removed, directly against the user's body. The housing includes a protuberance oriented to be held in contact against the user's body to provide a mechanical massage to supplement the hydromassage.

SUMMARY OF THE INVENTION

This application, as well as Applicant's parent application Ser. No. 08/200,472, describe further preferred embodiments for discharging a water stream for massaging a user's body. These embodiments preferably employ a membrane formed of flexible, limp material, e.g., terry cloth, mounted loosely, i.e., with slack, in front of the water stream discharge orifice. A water stream discharged from the orifice against the membrane rear face transfers a portion of its kinetic energy to the membrane front face for massaging the user's body. As contrasted with a stream directly impacting the user's body, the membrane has the effect of spreading, i.e., defocussing, the impact area to thus provide a softer more pleasing massage effect while minimizing the amount of unwanted splash.

A preferred hand held embodiment includes a housing comprised of a handle portion and a head portion. The hydromassage discharge orifice is mounted in the head portion for travel along a circular path propelled by a reactive force produced by the stream discharged therefrom. As the discharge orifice moves, it causes the stream to impact the rear face of the membrane tracing a circular path thereon. With the front face of the membrane held against the user's body, the impact will be transferred through the membrane enabling the user to experience a very pleasing massage.

Embodiments in accordance with the invention are useful in conjunction with water tubs, e.g., bathtubs or spas, and shower stalls, having a source of tap water. They can be configured as hand held or wall mounted units and function to discharge a hydromassage stream either out of, or submerged in, a tub water pool. They are preferably dimensioned to be driven by a tap water supply operating at a low flow rate (typically, ≧20 lbs per square inch at ≦2.5 gallons per minute) and can incorporate either a travelling or non-travelling discharge orifice and be operable with or without air and/or water entrainment.

The membrane in accordance with the invention serves to minimize unwanted splash when the hand held unit is lifted out of the water, whether inadvertently or to massage, or when the wall mounted unit is above the tub water level. The membrane is formed of flexible, limp material and is mounted in front of the discharge orifice, attached along a boundary defined by a continuous line or multiple discrete points. Within the massage area enclosed by the boundary, the membrane is configured to exhibit looseness or slack, i.e., lacking in tension, not taut. As a consequence, a water stream discharged from the orifice against the rear face of the membrane is able to transfer a portion of its kinetic energy through the membrane to the membrane front face held against the user's skin. The movement of the discharge orifice along its travel path acts to create a corresponding motion and pleasing massage effect against the user's skin. The membrane material can either be water permeable or water impermeable. Permeability is preferred because it affords better skin lubrication. The membrane is preferably configured for mounting on the housing so that it can be removed if the user desires a "sharper" feeling hydromassage. Removal also enables the membrane to be easily laundered.

In accordance with a preferred embodiment, means are provided for preventing water accumulation against the rear face of the membrane sufficient to distend the membrane. Such water accumulation could place the membrane in tension and diminish energy transfer therethrough. In the case of a permeable membrane, the permeability of the membrane itself can be sufficient to prevent such water accumulation. In any event, however, it is preferable to provide drain openings behind the membrane to prevent such water accummulation.

In accordance with another feature of a preferred embodiment, the hand held unit also includes a continuous shower spray outlet and a pulsed shower spray outlet. A user operable selector valve directs a supply water flow to either the continuous or pulsed shower spray outlets or to the hydromassage discharge orifice. The shower spray outlets and discharge orifice are preferably oriented to discharge through different housing faces.

DESCRIPTION OF THE FIGURES

FIG. 36 is a top view of a still further embodiment of the invention;

FIG. 37 is a sectional view taken substantially along the plane 37—37 of FIG. 36;

FIG. 38 is a sectional view taken substantially along the plane 38—38 of FIG. 37;

FIG. 39 is a sectional view taken substantially along the plane 39—39 of FIG. 37;

DETAILED DESCRIPTION

FIG. 1*a*

Figures 1A, 1B:
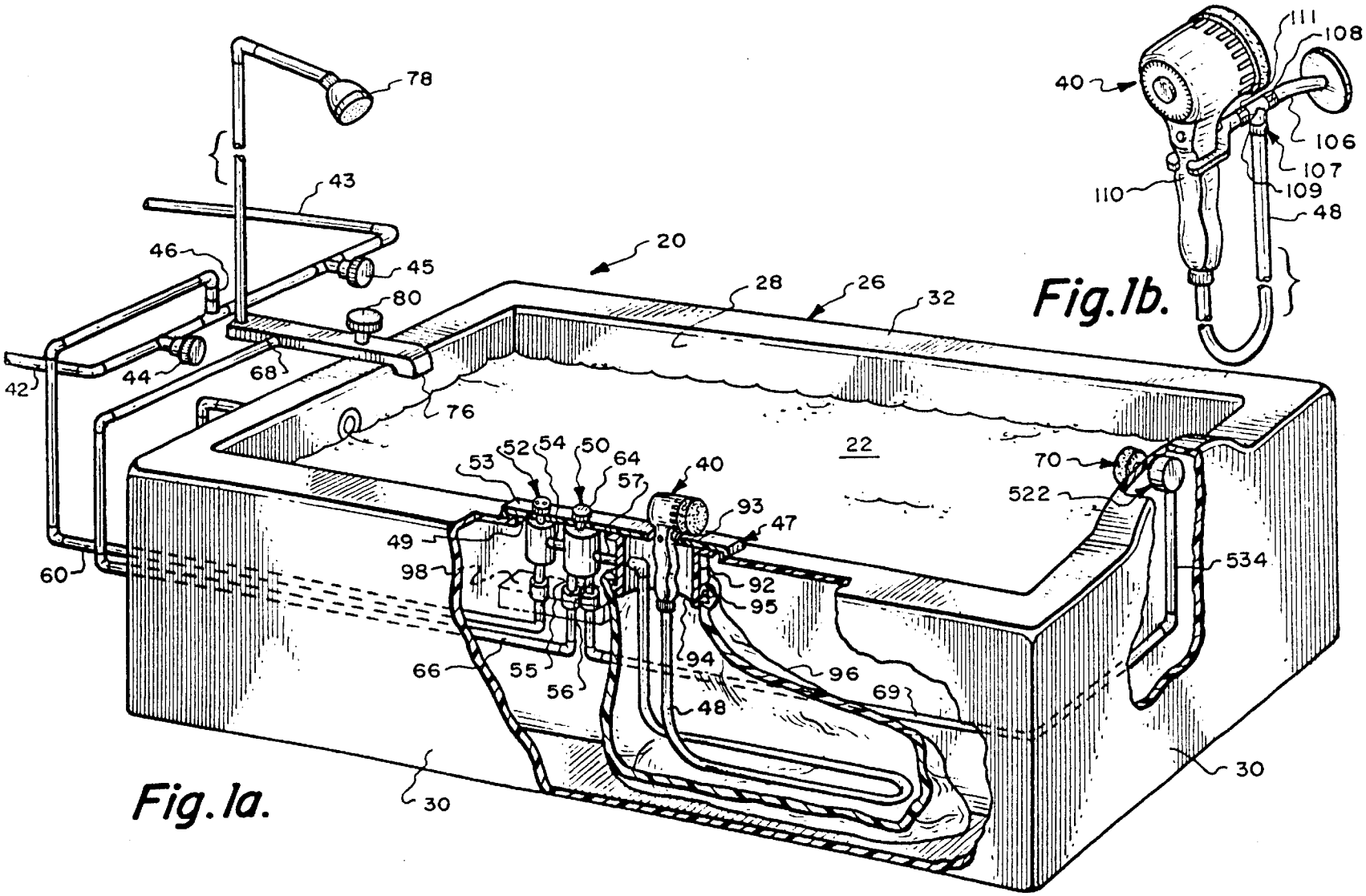
FIG. 1*a* is an isometric view of a bathtub, partially broken away, showing preferred tap water powered embodiments of the invention installed therein including a hand held water discharge apparatus 40 and a wall mounted water discharge apparatus 70.
FIG. 1*b* is an isometric view of the hand held water discharge apparatus of FIG. 1*a* alternatively mounted on a shower arm.
Figure 2:
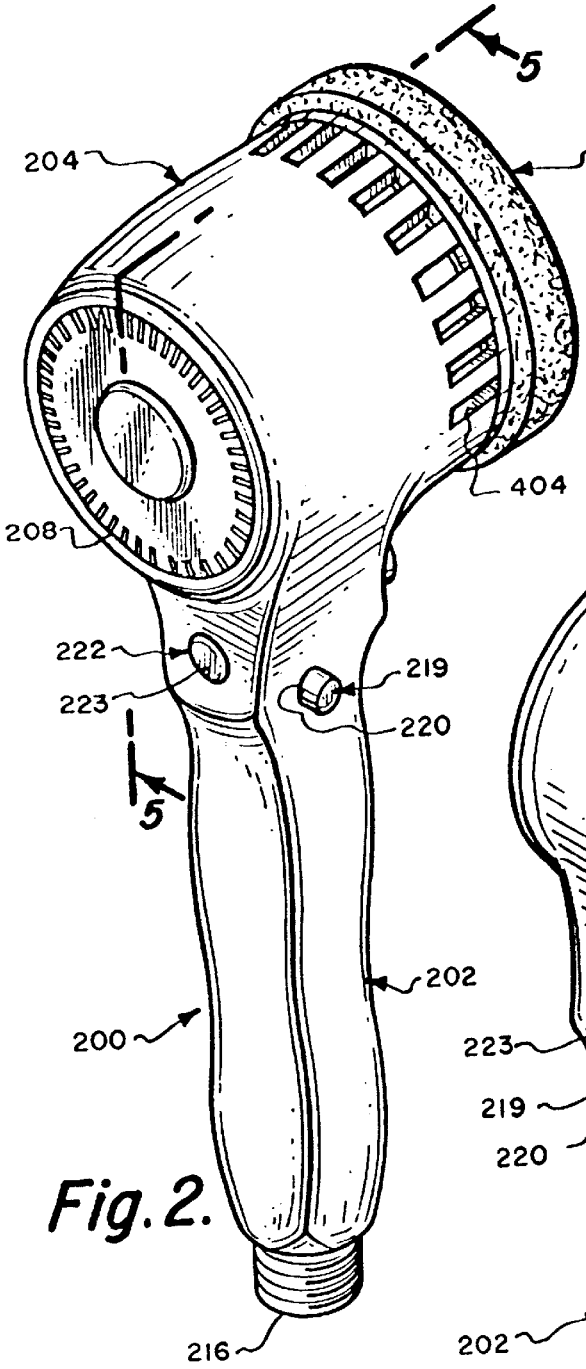
FIG. 2 is a rear isometric view of the hand held embodiment of FIGS. 1*a* and 1*b;*

Attention is now directed to FIG. 1*a* which illustrates an exemplary water tub 20 for accommodating a pool of water 22 in which a user can sit. The water tub includes a wall 26 essentially comprised of an inner wall portion 28, an outer wall portion 30, and a deck wall portion 32. A hand held unit 40, comprising a preferred embodiment of the invention, is designed to enable a user to selectively discharge either a shower spray or a hydromassage water stream (useful either out of, or submerged in, water pool 22). The unit 40 is capable of being driven by tap water supplied at a pressure ≧20 p.s.i. at a flow rate ≦3.0 g.p.m. from conventional supply pipes represented in FIG. 1*a* by hot water pipe 42 and cold water pipe 43. The pipes 42, 43 respectively supply tap water via control valves 44, 45 to a common coupler 46.

Figure 3:
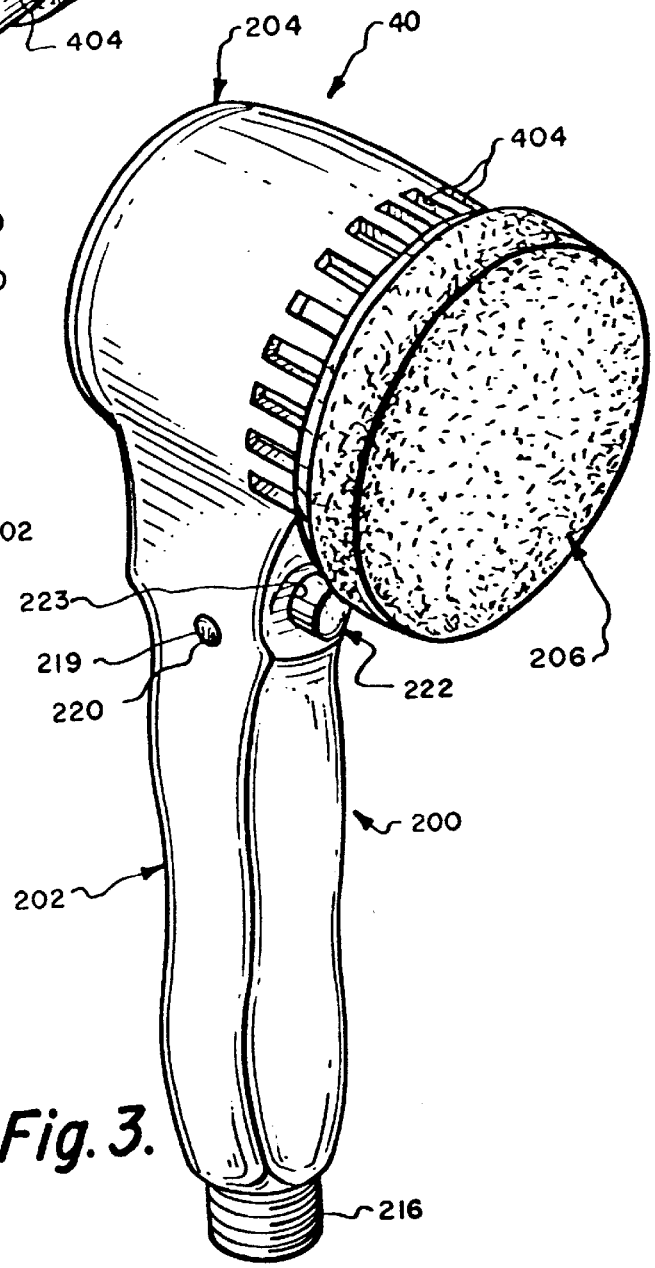
FIG. 3 is a front isometric view of the hand held embodiment of FIG. 2.

A deck mount water distribution subassembly 47 (of the type described in applicants' Patent 5,634,888) is preferably provided for efficiently installing the hand held unit 40, coupled to the end of flexible hose 48, in water tub 20. The subassembly 47 is intended for "drop-in" installation through an opening 49 in deck 32, as shown in FIG. 1*a*. The subassembly 47 preferably includes a device-selector valve 50 and an anti-siphon valve 52 mounted on plate 53. Plate 53 is configured to rest on deck 32 above opening 49 with the bodies of valves 50, 52 projecting downwardly therefrom. The selector valve 50 includes inlet nipple 54 and outlet nipples 55, 57. Pipe 60 supplies pressurized tap water from coupler 46 to inlet nipple 54 via anti siphon valve 52 (e.g., as shown in FIG. 3A of Patent 5,230,106). Selector knob 64 selectively directs the supplied tap water (1) via nipple 55 to pipe 66 for connection to faucet-shower nipple 68, (2) via nipple 56 to pipe 69 to wall mount unit 70 or (3) via nipple 57 through flexible hose 48 to hand held unit 40. The selector knob 64 is preferably configured to allow a user to variably control the flow rate of the tap water supplied through valve 50. When the selector knob 64 is in its first position, tap water is supplied via pipe 60 to nipple 68 and is then discharged in a conventional manner either through spout 76 or shower head 78, depending on the position of conventional user controlled valve 80.

The subassembly 47 includes a peripheral wall 92 depending from the lower surface of plate 53 surrounding an opening 93 in the plate. The opening 93 is dimensioned to accommodate an elongate handle portion 94 of the hand held unit 40 as shown in FIG. 1*a*. The mouth 95 of a closed container 96, e.g., a flexible bag, is secured around the peripheral wall 92. The aforementioned selector valve nipple 57 extends through peripheral wall 92 into the volume enclosed by wall 92 and container 96. A coupling block 98 is mounted beneath the deck opening 49 between inner and outer wall portions 28, 30 for facilitating installation of the subassembly 47.

The preferred hand held embodiment 40 can, in accordance with the invention, be operated in either a shower mode or a hydromassage mode, either above or submerged beneath the surface of tub water pool 22.

FIG. 1*b*

FIG. 1*b* illustrates the hand held unit 40 alternatively installed on a conventional wall mounted shower supply pipe 106. A preferred T-shaped adapter 107 has an inlet end 108 intended to be coupled to supply pipe 106 and an outlet end 109 coupled to hose 48 which is connected to the unit 40 as previously described. An anti-syphon valve (not shown) is incorporated between the adapter inlet and outlet ends. A Y-shaped yoke 110 is mounted on the adapter end 111, as shown, for accommodating unit 40.

FIGS. 2–10

Attention is now directed to FIGS. 2–10 which illustrate the hand held unit 40 in greater detail. The unit 40 is basically comprised of an integral housing 200 including a handle portion 202 and a head portion 204. As will be explained hereinafter, the handle portion 202 is mounted on the end of supply hose 48 which supplies water to the head portion 204 for discharge either through a hydromassage discharge orifice proximate to the head portion front face 206 or through shower hole openings in a rear face 208.

The handle portion 202 defines an internal elongate water passageway 214 extending from an externally accessible water supply entrance 216 to an internal water supply exit port 218. A first flow control slide valve 219 is mounted for reciprocal movement in channel 220 intersecting passageway 214 to permit a user to variably control water flow therepast. A second selector slide valve 222 is mounted for reciprocal movement in channel 223 oriented perpendicular to channel 220 and downstream therefrom for selectively directing supply water from exit port 218 to either hydromassage entrance port 224 or shower entrance port 226 (FIGS. 4–6).

More particularly, flow control slide valve 219 is comprised of a cylindrical member 230 having a reduced cross-section at gap 232. Circumferential grooves 234, 235 are formed in cylindrical member 230 on opposite sides of gap 232 for respectively receiving O-rings 236, 237. When the member 230 is moved to a position to align gap 232 with passageway 214 (FIGS. 7, 8), supply water flows past valve 219 to supply exit port 218. When member 230 is moved to the right (not shown) from the position shown in FIGS. 7, 8 to place gap 232 out of alignment with passageway 214, supply water flow to exit port 218 ceases except for a preferred low flow rate leakage past valve 219. Total shut off of the supply water flow is preferably accomplished at valves 44, 45 (FIG. 1*a*).

Selector slide valve 222 is similarly comprised of a cylindrical member 238 having a reduced cross-section at gap 240. Circumferential grooves 242, 243 are formed in cylindrical member 238 for respectively receiving O-rings 244, 245. The cylindrical member 238 is dimensioned to slide within channel 223 and end O-rings 246, 247 which seal the ends of the channel. The member 238 is moveable between a first shower mode position (FIG. 6) in which gap 240 communicates exit port 218 with shower supply entrance port 226 and a second hydromassage mode position (FIG. 5) in which gap 240 communicates exit port 218 with hydromassage entrance port 224.

Figure 4:
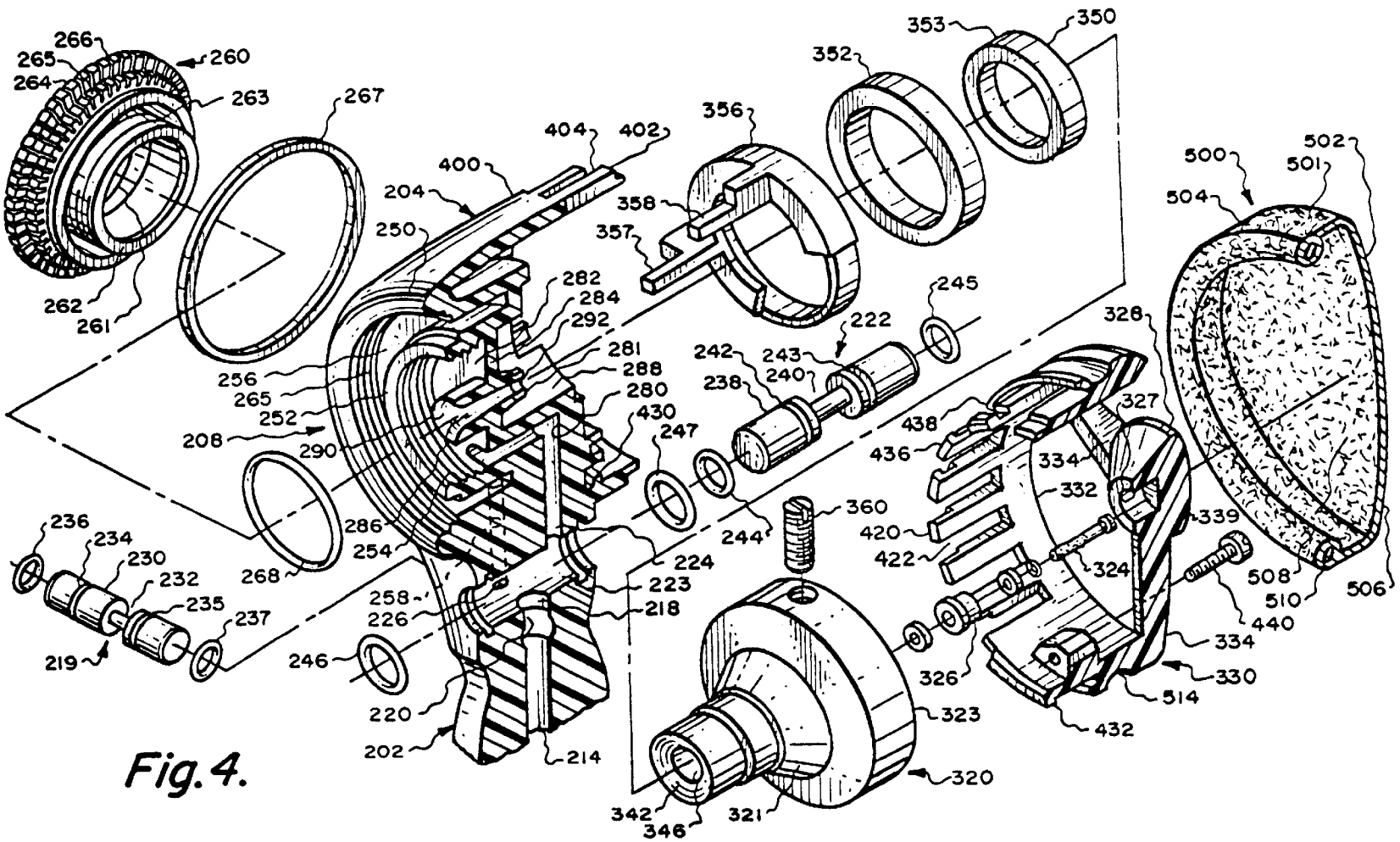
FIG. 4 is an exploded isometric view of the hand held embodiment depicted in FIGS. 2 and 3.
Figure 6:
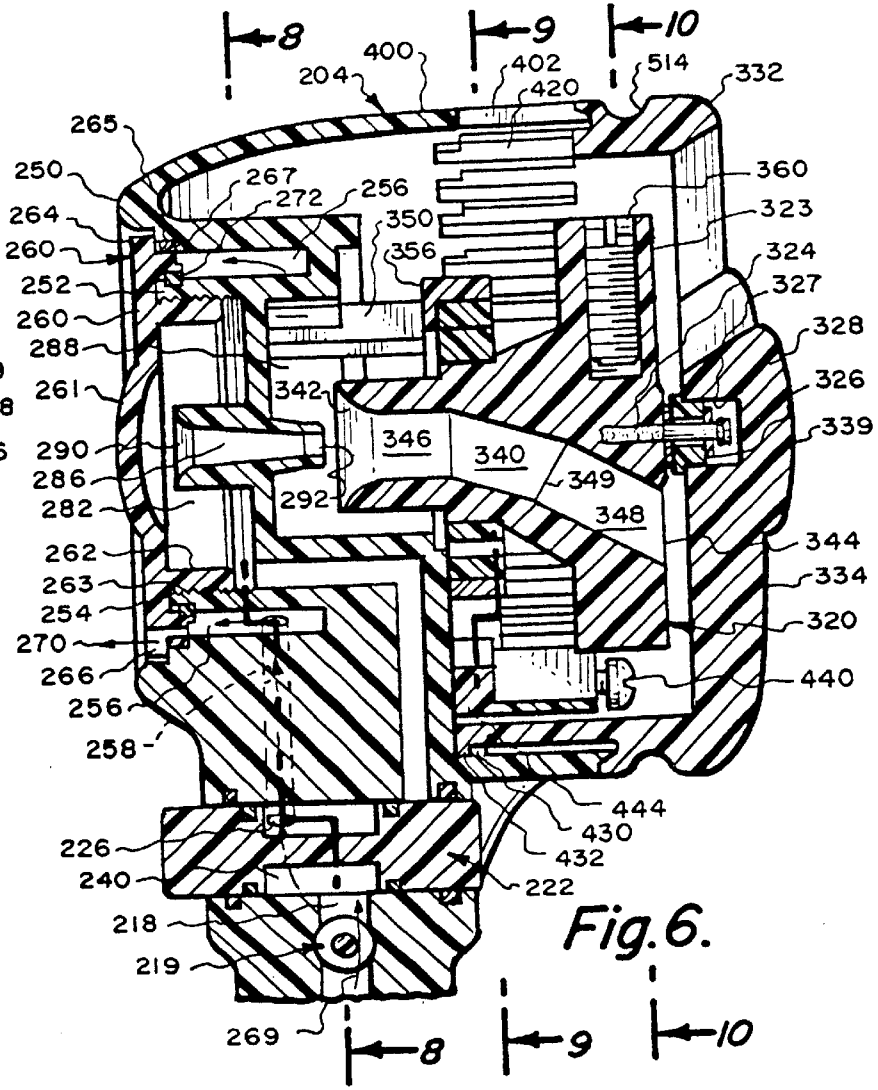
FIG. 6 is a sectional view identical to FIG. 5 except, however, depicting operation in the shower mode.
Figure 5:
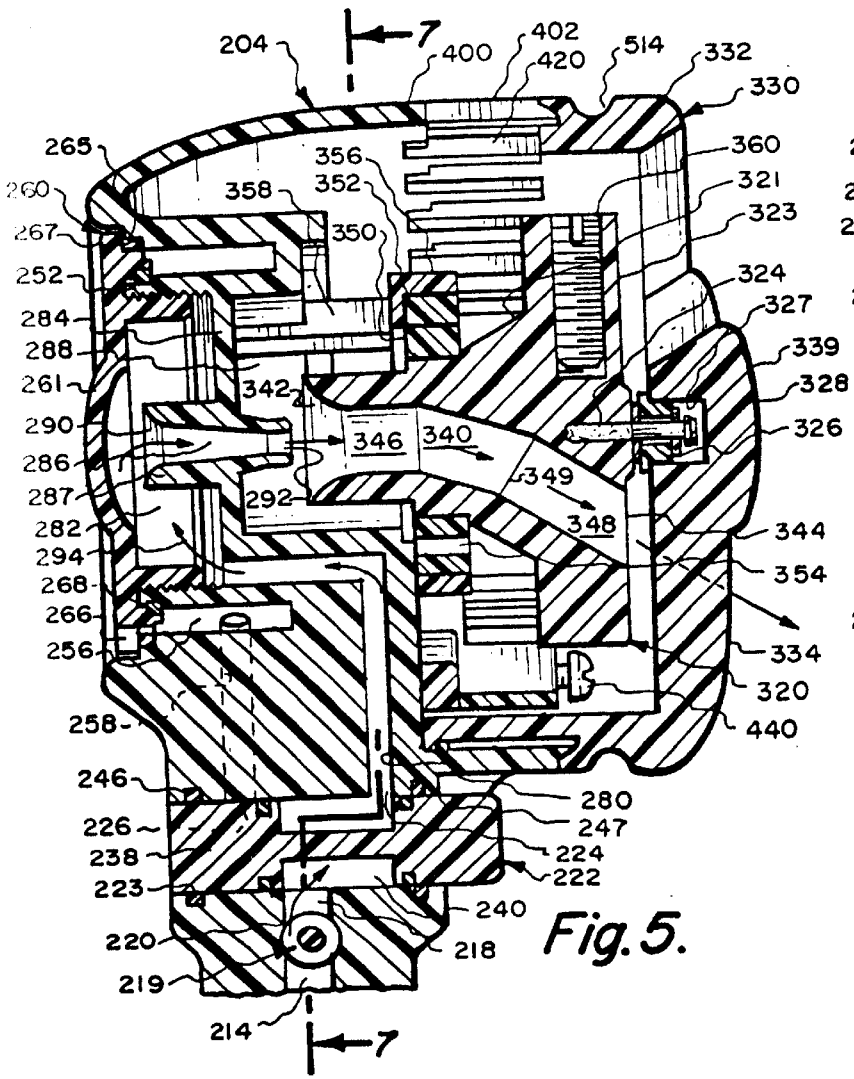
FIG. 5 is a sectional view taken substantially along the plane 5—5 of FIG. 2 depicting operation in the hydromassage mode.
Figure 8:
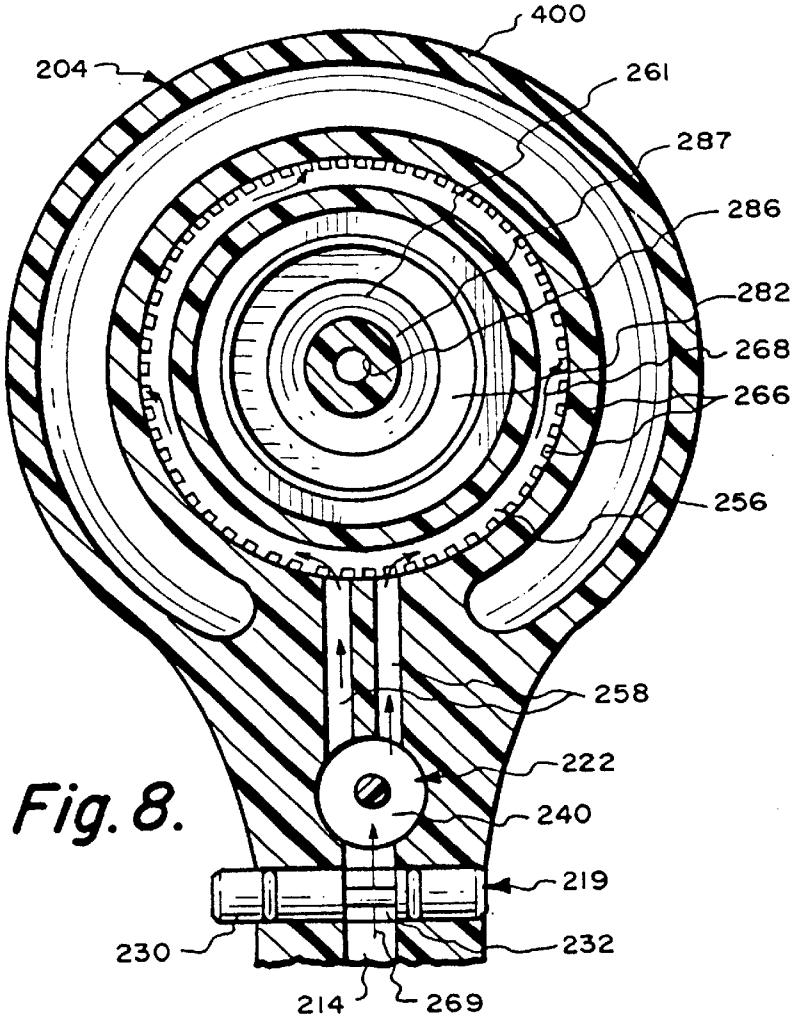
FIG. 8 is a sectional view taken substantially along the plane 8—8 of FIG. 6.
Figure 7:
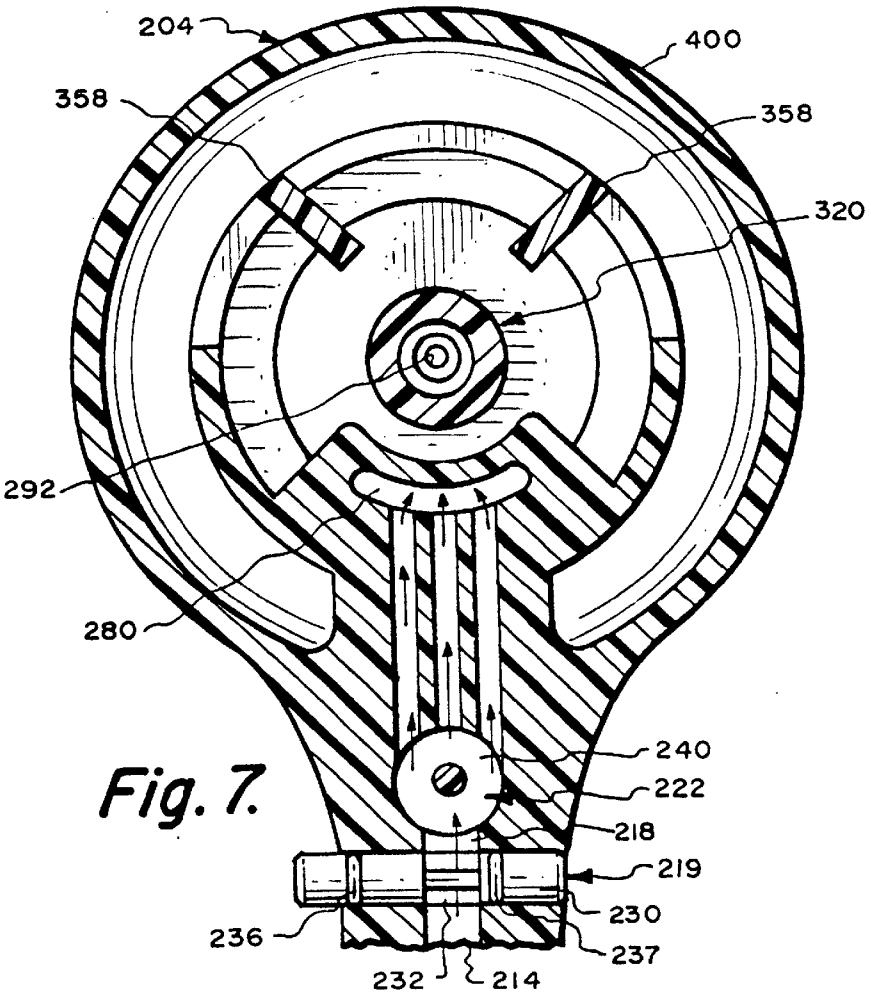
FIG. 7 is a sectional view taken substantially along the plane 7—7 of FIG. 5.
Figure 10:
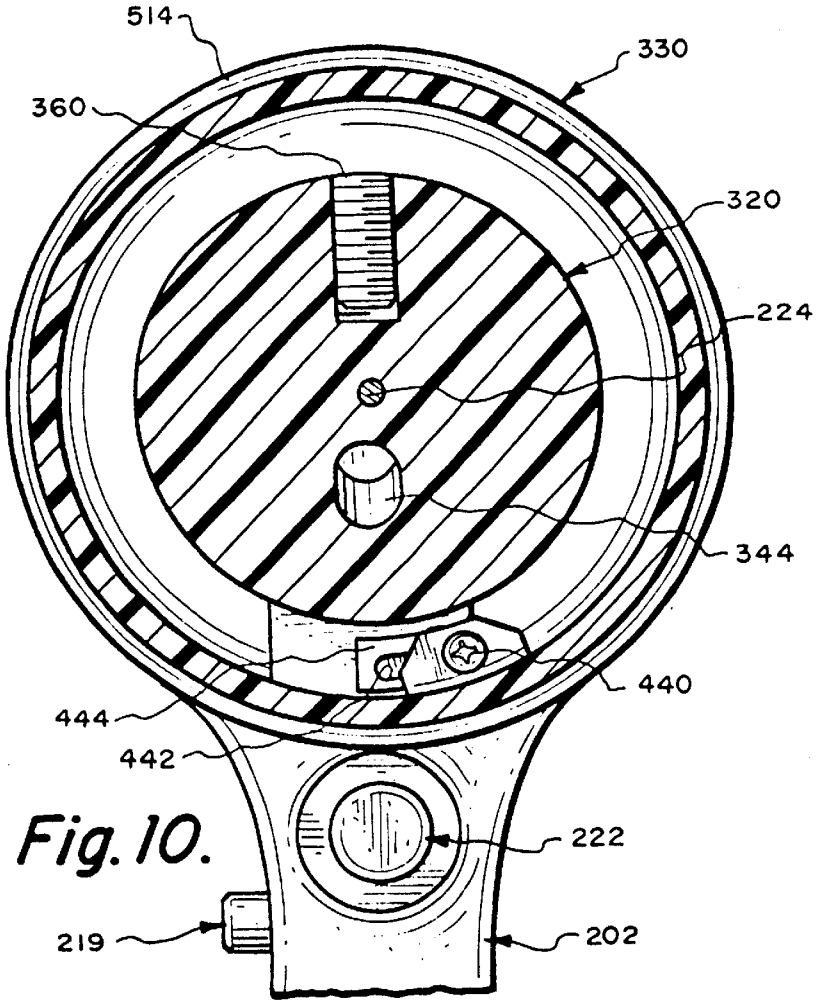
FIG. 10 is a sectional view taken substantially along the plane 10—10 of FIG. 6.

Initially considering operation in the shower mode, attention is directed primarily to FIGS. 4, 6 and 8. The head portion rear face 208 is framed by a peripheral lip 250 which extends around an axially extending concentric nipple 252, internally threaded at 254. An annular shower water manifold 256 is defined between lip 250 and nipple 252. Passageway 258 couples shower entrance port 226 to manifold 256.

A shower outlet ring 260 is provided having a closed face 261 (FIG. 6) and a cylindrical boss 262 extending axially therefrom, externally threaded at 263, for coupling to nipple 252. The ring 260 defines an outer circumferential surface 264 which steps down to an inner circumferential surface 265. A plurality of radial slits 266 extend into circumferential surfaces 264, 265. A gasket ring 267 fits around inner circumferential surface 265 to direct water flow from manifold 256 (FIG. 6) through radial slits 266 which comprise shower spray outlets. An O-ring 268 is preferably mounted around the annular manifold 256 to prevent leakage therefrom.

Thus, in use in the shower mode, supply water 269 (FIG. 6) will flow past flow control valve 219 and selector valve 222 into shower entrance port 226, and then via passageway 258 into manifold 256 from which a shower stream 270 will issue from each radial slit 266.

Attention is now primarily directed to FIGS. 4,5,7,9 and 10 which depict views of the hand held unit 40 which best illustrate its operation in the hydromassage mode. For operation in the hydromassage mode, the selector valve 222 must be in the position depicted in FIG. 5 so as to communicate supply exit port 218 with hydromassage entrance port 224. A passageway 280 extends from entrance port 224 to a chamber 282 substantially sealed between the shower outlet ring closed face 261 and internal wall 284 extending across nipple 252. The only outlet from chamber 282 is defined by nozzle passageway 286 formed in boss 287 extending axially through wall 284 to cavity 288. The nozzle passageway 286 converges from a wider entrance 290 to an exit orifice 292 having a reduced cross section (i.e., ≦0.20 inch diameter) to thus increase the velocity of water flow 294 and discharge a high velocity jet flow 295 into cavity 288. A prototype unit in accordance with the embodiment of FIGS. 4–10 uses an exit orifice 292 having a diameter =0.010 inch and outputs 2.0 g.p.m. with a supply pressure of 60 p.s.i.

Mounted for rotation within the head housing 204 is a hydromassage member 320 comprising a funnel shaped block 321 having a front face 323 secured to axial pin 324. Pin 324 is in turn mounted for rotation in bearing 326 accommodated in recess 327 in hub 328 of frame 330 defined by an outer ring 332 and multiple legs 334. Legs 334 extend radially from the hub 328 to the outer ring 332 which essentially defines the aforementioned head portion front face. The hub 328 comprises a protuberance defining a front surface projecting forwardly of legs 334. Front surface 339 is intended to be held against a user's body for mechanically massaging.

A hydromassage passageway 340 is defined in the hydromassage member 320 extending between an entrance orifice 342, and a discharge orifice 344 formed in front face 323 of member 320. The passageway 340 includes a first elongate portion 346 oriented at a first acute angle relative to the rotation axis defined by pin 324 and a second elongate portion 348 which deviates at 349 by an acute angle relative to portion 346. Note that the discharge orifice 344 defined by passageway portion 348 is radially displaced from the pin 324. Thus, water flowing into entrance orifice 342 will traverse passageway portions 346 and 348 prior to exiting at discharge orifice 344. The directional change imposed on the water flow through passages 346 and 348 creates a tangentially directed moment arm to thus rotate member 320 about the rotation axis defined by pin 324. Note that the member 320 carries a bearing ring 350 which rotates within a fixed outer bearing ring 352. The inner bearing ring 350 is preferably eccentrically configured to define a high point 353 oriented opposite to the discharge orifice 344. This creates a space 354 (FIG. 9) between the bearing rings in which a small amount of water can be drawn into the cavity 288 for lubricating the adjacent bearing ring surfaces. Bearing ring 352 is accommodated in a cup-shaped frame member 356 having rearwardly projecting legs 357, 358 which axially locate frame member 356.

The member 320 preferably carries an eccentrically mounted weight 360 proximate to its peripheral surface preferably located diametrically opposite to discharge orifice 344. The purpose of this weight is to enhance the mechanical massaging afforded by the protuberance 328 when it is held against the user's skin and the unit is operated in the hydromassage mode.

The cavity 288 is partially defined and enveloped by the annular outer wall 400 of housing head portion 204. The front annular edge of wall 400 is defined by forwardly projecting fingers 402 spaced by intermediate slots or ports 404. The ports 404 provide a path from outside the housing 200 to the internal cavity 288.

The frame 330 is configured for mounting on the housing portion 204 in cooperative relationship with the forwardly projecting fingers 402. More particularly, the frame outer ring 332 has a plurality of fingers 420 which extend rearwardly and are spaced by slots 422. When the frame 330 is mounted adjacent the front edge of wall 400, its rearwardly extending fingers 420 lie radially inward of fingers 402 projecting forwardly from wall 400. The frame 330, as will be discussed, is mounted for limited rotation relative to the wall 400 between a first position in which the cavity 288 is essentially closed and a second position in which the cavity 288 is open to the outside. More particularly in the first position, the frame 330 is rotated to align the rearwardly extending fingers 420 with the slots 404 to thus close the cavity 288. In the second position (FIG. 9), fingers 420 are aligned with fingers 402 thus aligning slots 404 and 422 and opening the path from the cavity 288 to the outside.

Figure 9:
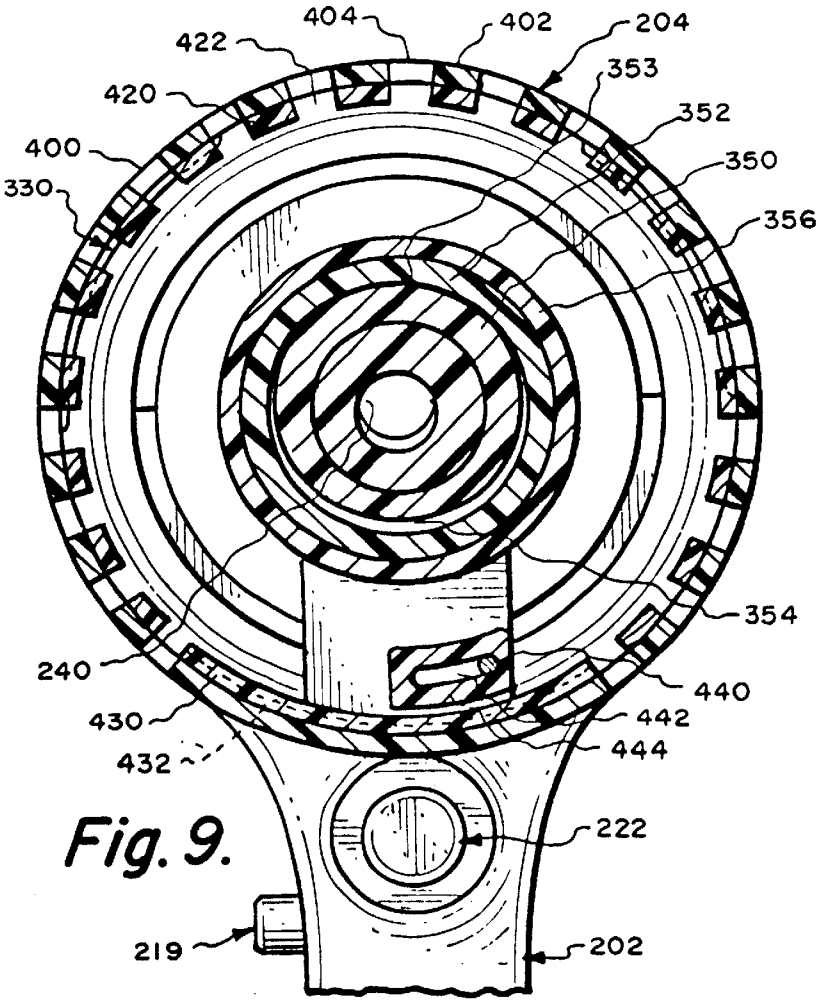
FIG. 9 is a sectional view taken substantially along the plane 9—9 of FIG. 6.

In order to mount the frame 330 on the head portion 204 for rotation between the aforementioned first and second positions, a bayonet type interconnection is preferably provided. Thus, the head portion 204 is provided with at least one radially inwardly extending flange 430 extending partially around the housing wall 400. The rear edge of frame outer ring 332 is provided with a terminal hook 432 configured to rotate behind the flange 430 to secure the frame 330 against axial movement relative to the head portion wall 400. In addition to the hook 432, terminal hooks 436 are provided on selected fingers 420 to define a groove 438 to accommodate an additional appropriately positioned flange section (not shown) projecting inwardly from the wall 400. Rotation of frame 330 relative to housing wall 400 is limited by bolt 440 which is carried by frame 330 and projects into a short arcuate slot 442 formed in block 444 (FIG. 9).

In accordance with a significant aspect of the embodiment of FIGS. 2–10, a membrane 500 is provided formed primarily of a flexible, limp material 501 such as a water permeable terry cloth or a water impermeable vinyl. As depicted in FIG. 4, the membrane is essentially comprised of a front panel 502 extending rearwardly via an annular wall portion 504 to a peripheral rear bead 505. The front panel 502 defines front and rear faces 506 and 508. An annular elastic member 510 is preferably secured to the membrane 500 by extending through a channel in the rear bead 505. The elastic member 510 is dimensioned to be received in an annular groove 514 defined in the exterior surface of frame outer ring 332. The membrane front panel 502 thus extends across the head portion open front face 206 defined by frame outer ring 332 in front of the protuberance front surface 339.

Figure 34C:
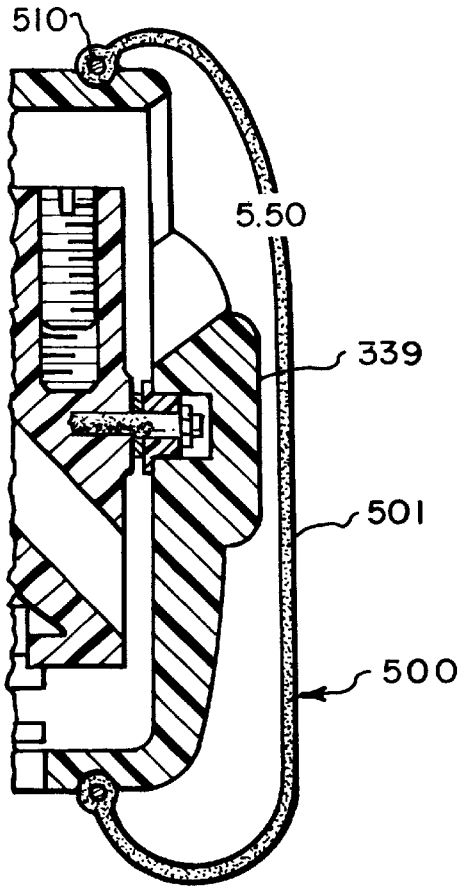
FIG. 34*c* schematically depicts (for wet and dry conditions) the dimensions of a preferred membrane exhibiting slack across the open face.
Figure 34B:
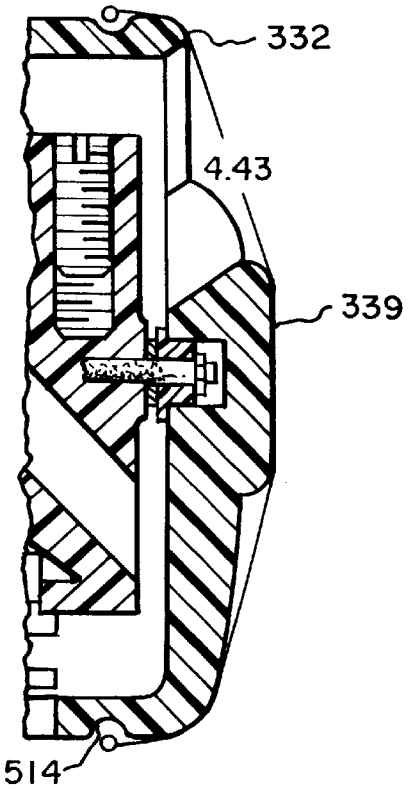
FIG. 34*b* schematically depicts the dimension of a taut, flexible member across the open face of the head portion of FIG. 34*a;*
Figure 34A:
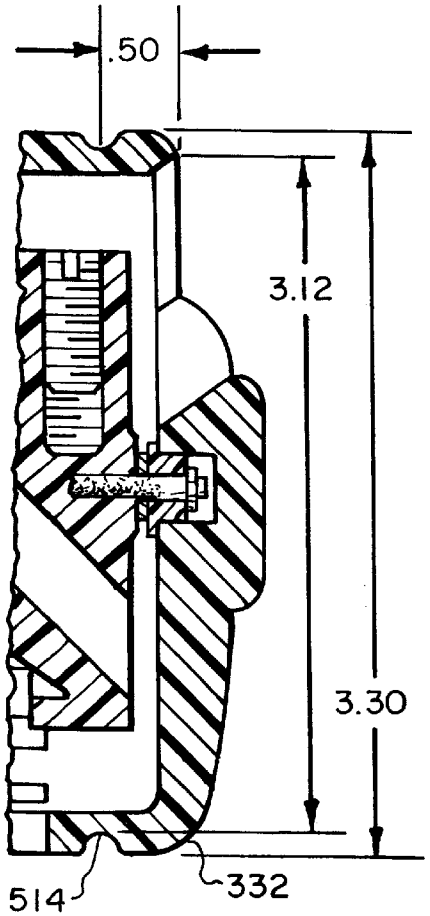
FIG. 34*a* is a fragmentary sectional view of the head portion of the apparatus of FIGS. 4–10 showing exemplary dimensions.

Attention is now parenthetically directed to FIGS. 34*a*, 34*b*, and 34*c* which depict the details of a preferred membrane 500 and its dimensional relationship to frame outer ring 332. The membrane 500 is formed of flexible, limp material 501 and is preferably dimensioned so as to be slack or loose across the open front face, i.e., massage area enclosed by outer ring 332. More particularly, FIG. 34*a* depicts exemplary dimensions of a typical head 204 and FIG. 34*b* shows what the diameter dimension would be (i.e., approximately 4.43 inches) for a membrane selected to lie taut across the ring 332 and the protuberance front surface 339.

In accordance with a preferred embodiment of the invention, as depicted in FIG. 34*c*, the membrane 500 is dimensioned larger than the taut dimension (i.e., greater than the 4.45 inches represented in FIG. 34*b*). More particularly, as represented in FIG. 34*c*, the preferred membrane is selected to have a diameter of approximately 5.50 inches so that it is loose or slack within the massage area bounded by ring 332.

Although the membrane 500 is shown in the drawings as being attached to the head 204 by a continuous elastic member 510, alternative attachment means can be readily used. For example, Velcro fasteners can be provided to define an attachment boundary defined either by a continuous line or by multiple discreet points. Regardless of how the attachment boundary is formed, the limp membrane material 501 is, in accordance with the invention, dimensioned to be loose or slack within the massage area.

As the hydromassage member 320 rotates about axial pin 324 in response to the discharge of the water stream from discharge orifice 344, the stream produces a reaction force tending to move the protuberance 328 laterally relative to the axis in a direction opposite to the direction of discharge. By applying firm, but gentle, pressure of the protuberance surface 339 against the user's skin through the membrane material 501, the protuberance will mechanically massage the user while the eccentric weight 360 exaggerates this motion to enhance mechanical massaging. This mechanical massaging effect supplements the hydromassage effect produced by the stream emanating from the discharge orifice 344 which massages the user through the membrane 500 as it moves along its circular travel path.

Figure 35C:
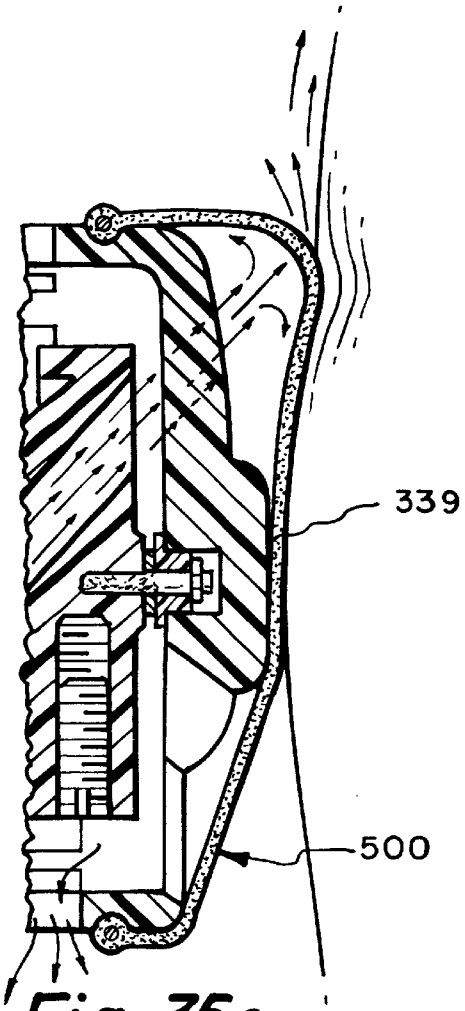
FIGS. 35*a* and 35*b* schematically depict the deformation of a preferred membrane when impacted by a discharged stream and FIG. 35*c* depicts the membrane with its front face held against a user's body.
Figure 35B:
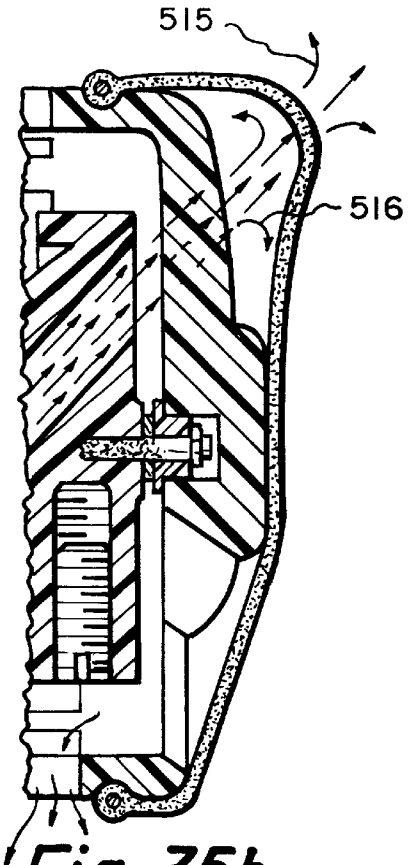
Figure 35A:
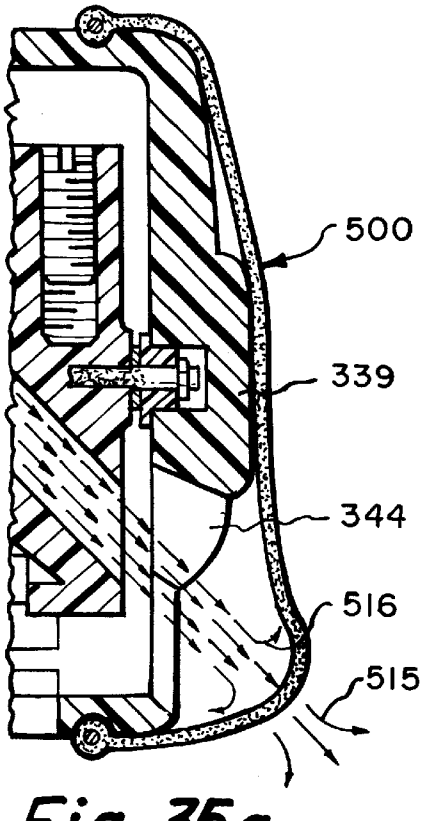
Figure 40:
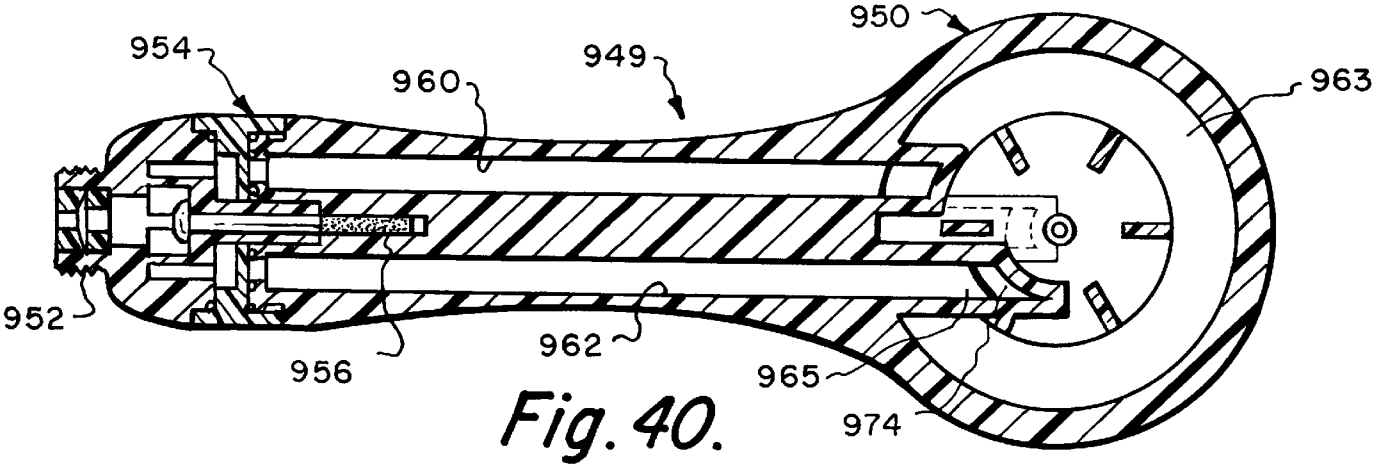
FIG. 40 is a sectional view taken substantially along the plane 40—40 of FIG. 37.
Figure 41:
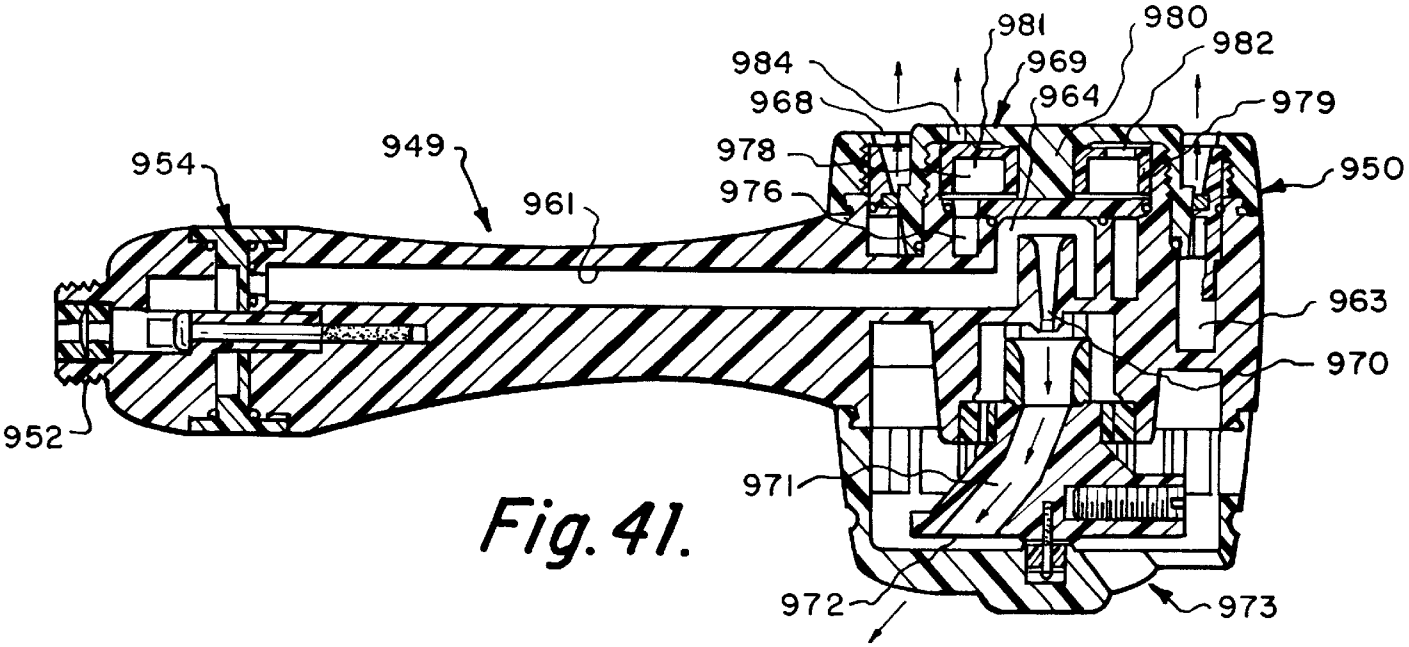
FIG. 41 is a sectional view identical to FIG. 37 but showing water flow arrows for the different operational modes.

More particularly, FIGS. 35*a* and 35*b* depict how the kinetic energy of the stream discharged from orifice 344 deforms the limp slack membrane 500 as it moves along its travel path. The membrane material 501 is preferably water permeable, e.g., terry cloth, so that at least a portion 515 of the stream passes through the membrane while another portion 516 is reflected from the membrane rear face 508 and drains out through slotted openings 422. When using a water impermeable membrane, the entire water stream discharged from orifice 344 will be reflected from the membrane rear face 508 and drained via slotted openings 422. In either situation, water accumulation behind the membrane is minimized to prevent pressure buildup sufficient to distend the membrane. Rather, the membrane is intended to be slack to allow the stream impact to deform the membrane for enhancing the massaging effect.

FIG. 35*a* depicts the action of the discharged stream against the membrane 500 when the protuberance front surface 339 is held against the user's body. Note how the stream impact deforms or bulges the membrane at a location displaced from the protuberance surface 339.

The unit 40 can be used in the hydromassage mode either underwater or out of the water and either with or without the membrane structure 500 in place. When used underwater, the cavity 288 will typically be flooded and the high velocity jet flow from orifice 292 into hydromassage entrance 342 will entrain water from the cavity to form a flow of increased mass and reduced velocity to discharge from discharge orifice 344. With the membrane structure 500 in place, the membrane material will spread or defocus the impact to provide a soft pleasing massage effect. If the membrane is removed, the user will experience a sharper, more focused impact. When the unit is used out of the water with a water permeable membrane, the housing ports 404 may be closed to accumulate sufficient water in the cavity 288 for entrainment by the high velocity flow entering the hydromassage entrance orifice 342, thus enabling the unit to discharge a soft pleasing massage effect even when used out of the water. The permeable membrane, in addition to softening the discharge to enhance the hydromassage effect, also minimizes unwanted splash.

FIG. 11

Figure 11:
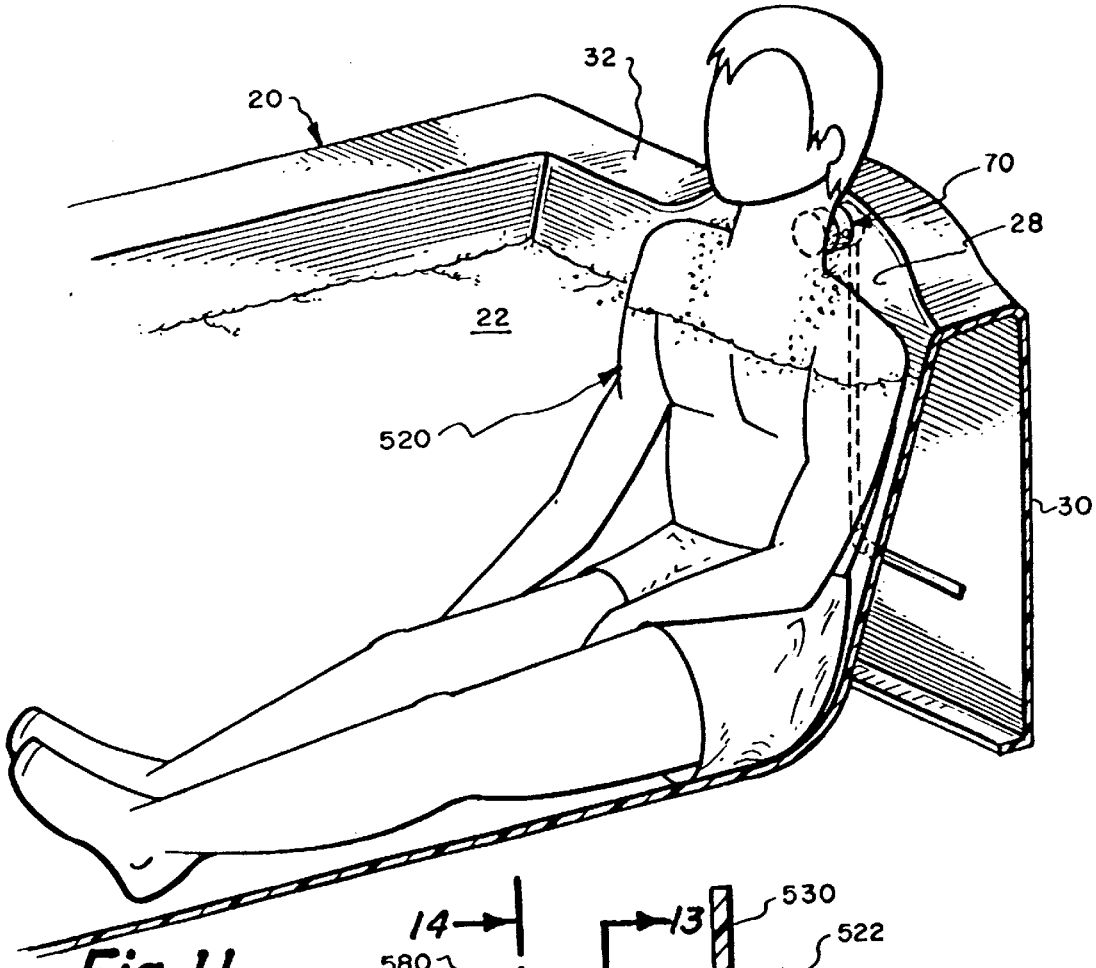
FIG. 11 is an isometric view of a bathtub partially broken away, showing a user positioned adjacent the wall mounted discharge apparatus 70 of FIG. 1*a*.

Attention is now directed to FIG. 11 which shows a user 520 sitting in the water tub 20 in front of the aforementioned wall mount unit 70. Note that the unit 70 is mounted proximate to deck 32, above the level of water pool 22, positioned for massaging the neck and/or shoulder of user 520.

FIGS. 12–15

Figure 16:
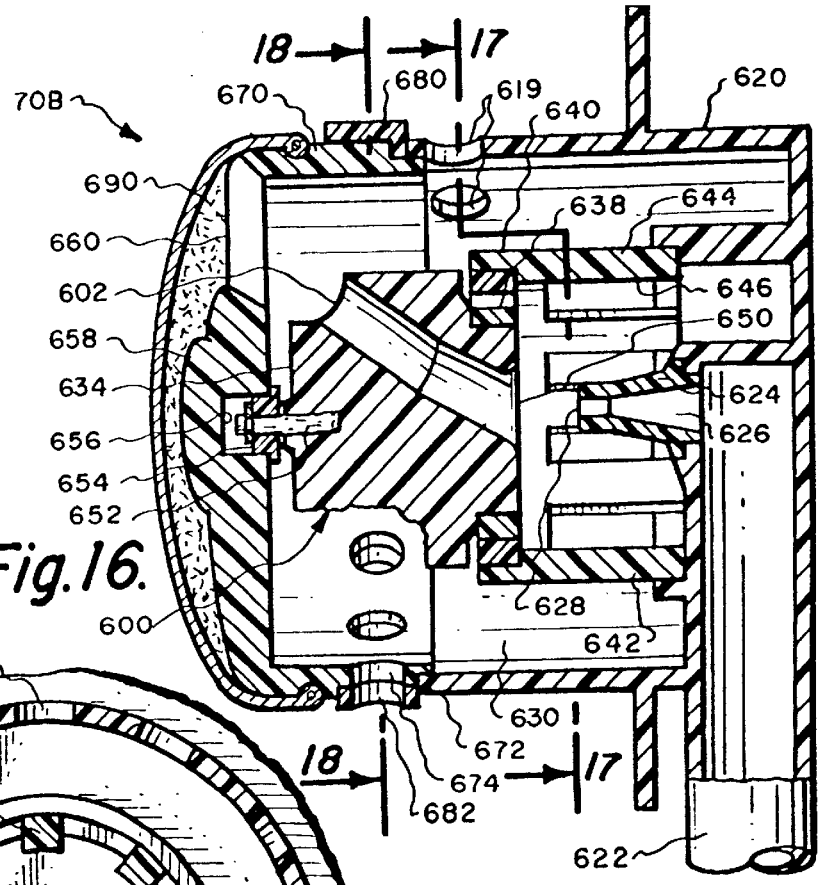
FIG. 16 is a vertical sectional view through an alternative wall mounted discharge apparatus (as in FIG. 11) having a travelling discharge orifice.
Figure 17:
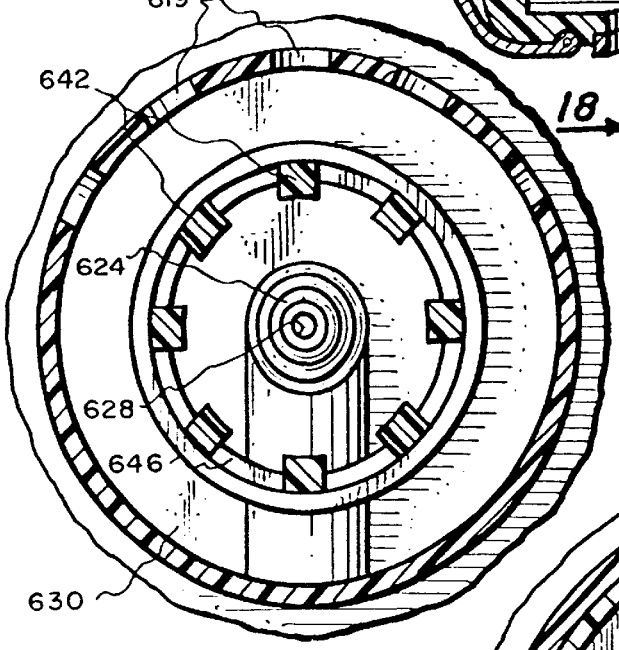
FIG. 17 is a sectional view taken substantially along the plane 17—17 of FIG. 16.
Figure 18:
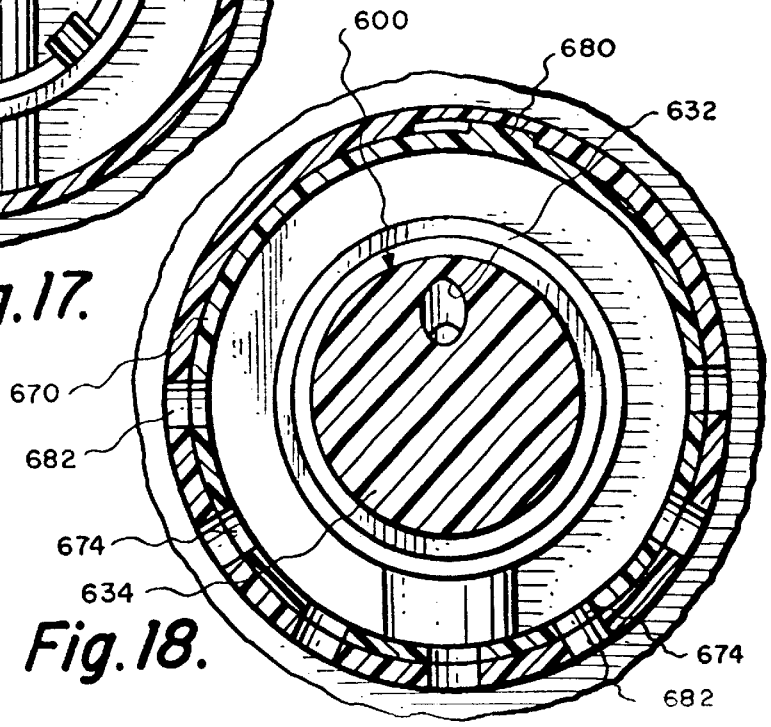
FIG. 18 is a sectional view taken substantially along the plane 18—18 of FIG. 16.

A first embodiment 70A of wall mount unit 70 having a non-travelling discharge orifice is shown in FIGS. 12–15. A second embodiment 70B of wall mount unit 70 having a travelling discharge orifice is shown in FIGS. 16–18.

The unit 70A is comprised of a substantially cylindrical housing 522 having a sidewall 524, a rear wall 526 and an open front face 528. A radial flange 530 extends outwardly from the sidewall 524 for engaging the interior surface of bathtub inner wall portion 28. The portion of the housing 522 projecting forwardly from the flange 530 toward the open face 528 extends through an opening in the wall portion 28 to enable the user 520 to locate his neck and upper back proximate to the housing front face 528, as will be more specifically discussed hereinafter.

The housing 522 is configured with a pipe section 534 intended to be coupled to pipe 69, as shown in FIG. 1*a*. The pipe section 534 enters the housing 522 and at its upper end communicates with passageway 536 formed in boss 537. The passageway 536 converges from a relatively wide entrance 540 to a reduced cross section exit orifice 542 which opens into cavity 546 formed interiorally of housing 522. A short conduit 550 defining an entrance throat 552 and a straight wall passageway 554 is axially aligned with exit orifice 542. The conduit 550 is supported by radial arms 556 extending inwardly from the housing sidewall 524. The conduit straight wall portion 554 terminates at its forward end at discharge orifice 560, proximate to the open front face 528 of housing 522.

Figure 12:
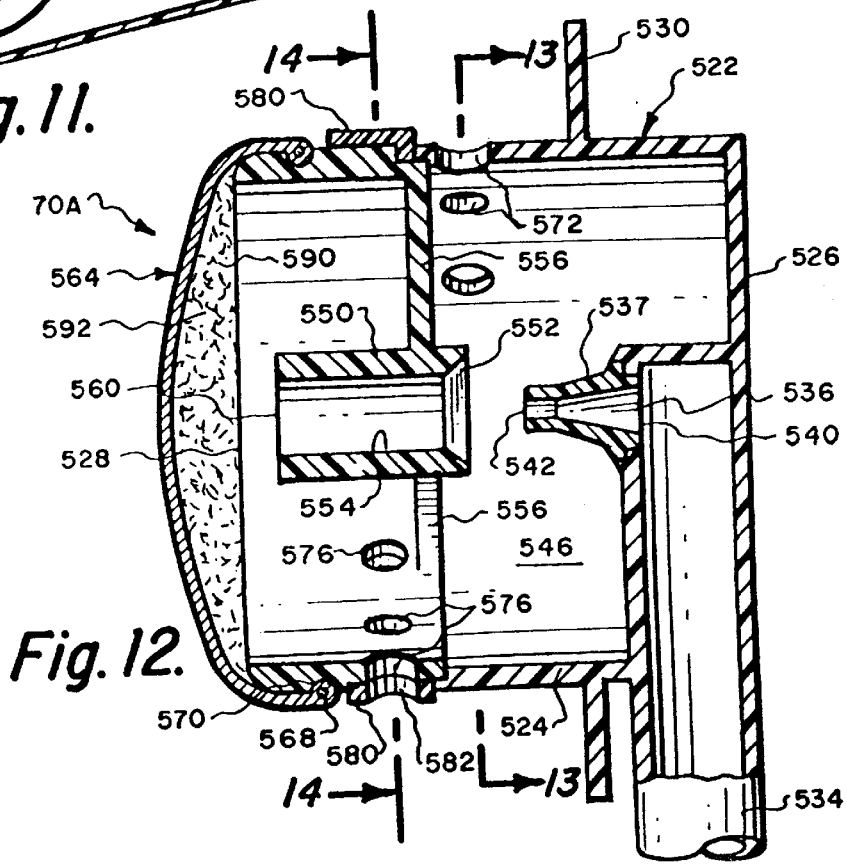
FIG. 12 is a vertical sectional view through a wall mounted discharge apparatus (as in FIG. 11) having a non-travelling discharge orifice.

As is best shown in FIG. 12, a water permeable membrane structure 564, essentially identical to the aforementioned membrane structure 500 represented in FIGS. 34, 35, is mounted across the front face 528 of housing 522. The structure carries an annular elastic member 568 which extends into annular groove 570 defined in the exterior surface of housing sidewall 524.

Figure 13:
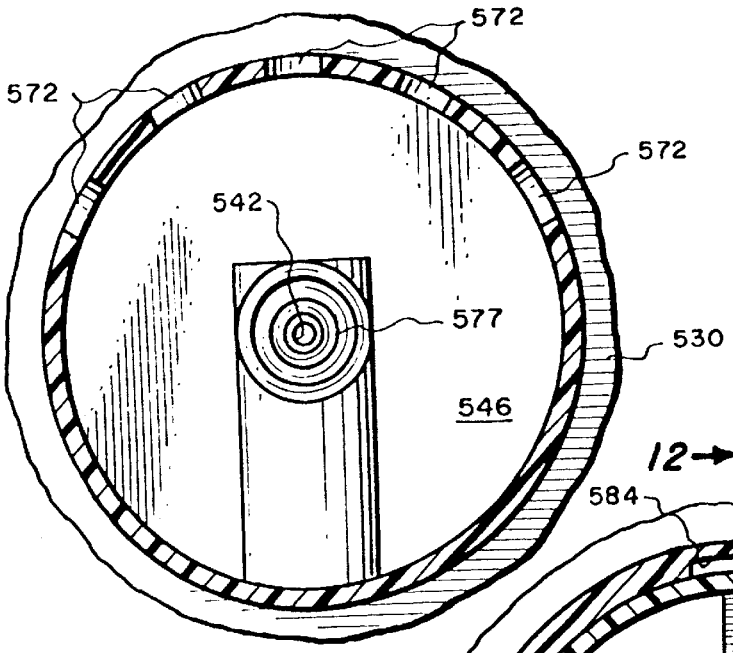
FIG. 13 is a sectional view taken substantially along the plane 13—13 of FIG. 12.
Figure 14:
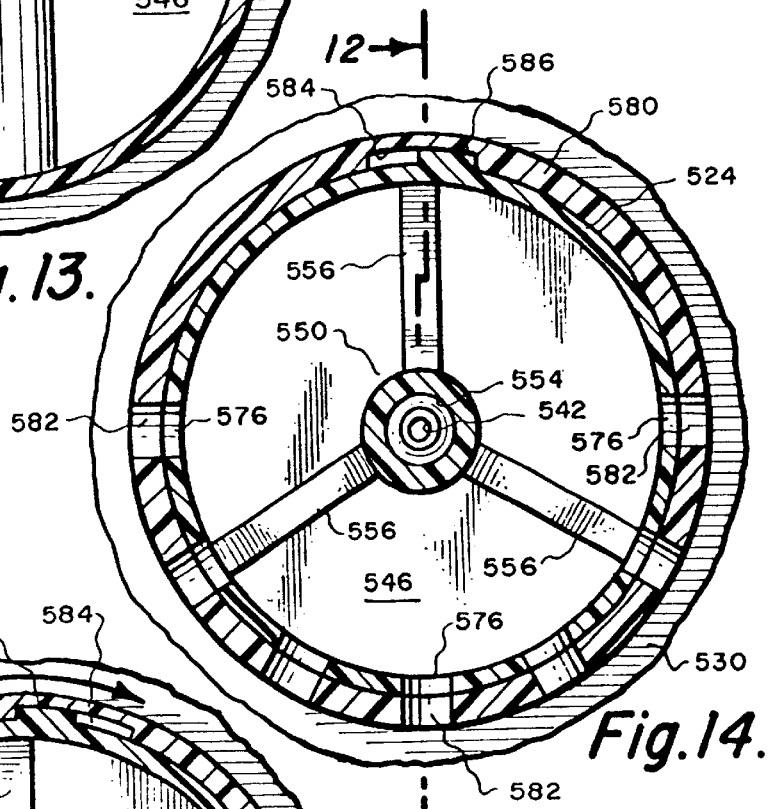
FIG. 14 is a sectional view taken substantially along the plane 14—14 of FIG. 12 showing the apparatus drain holes open for hydromassage operation without water entrainment.
Figure 15:
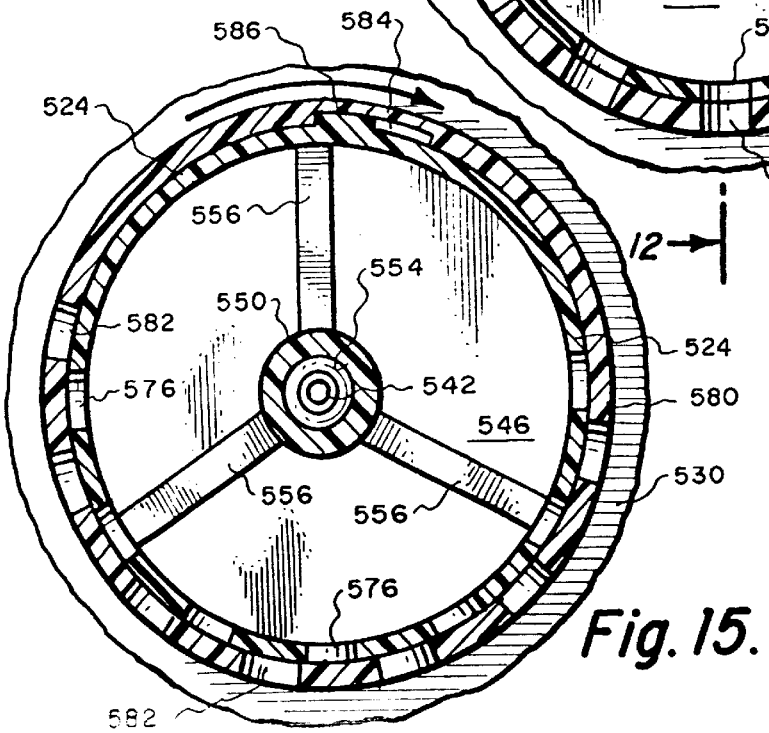
FIG. 15 is a sectional view similar to FIG. 14 showing the drain holes closed for hydromassage operation with water entrainment.

As is best shown in FIG. 13, at least one overflow hole 572 is formed in the housing sidewall 524 vertically above the axis of exit orifice 542. Note in FIG. 13 that the overflow holes 572 are preferably located between a 10 o'clock and 2 o'clock position. Also note the provision of drain holes 576 in the lower portion of housing wall 524 vertically beneath the exit orifice 542. As shown in FIG. 14, the drain holes 576 are located between the 3 o'clock and 9 o'clock positions.

A collar 580 is mounted for limited rotation around the exterior surface of housing wall 524. The collar is perforated to define a series of openings 582. When the collar 580 is rotated to the position shown in FIG. 14, the openings 582 align with the drain holes 576 in the housing wall 524. On the other hand, when the collar 580 is rotated to the position depicted in FIG. 15, the openings 582 move out of alignment thus closing the drain holes 576. The rotation of the collar 580 on the housing wall 524 is limited by a short annular slot 584 on the collar which receives a fixed tab 586 projecting radially outwardly from housing wall 524.

In normal operation, supply water from pipe section 534 will enter passageway 536 to produce a high velocity discharge out of reduced cross section exit orifice 542. This high velocity discharge will enter the passageway through conduit 550 emerging from discharge orifice 560 for impact against the rear face 590 of membrane material 592. With the collar 580 in the position shown in FIG. 15, i.e., with the drain holes at least partially closed, water reflected from the membrane rear face 590 can accumulate in cavity 546 to a level above the axis of the exit orifice 542 and conduit 550. When this occurs, the high velocity discharge from orifice 542 will entrain water as it enters the conduit 550, thus providing a flow of increased mass and lower velocity at the discharge orifice 560 for impacting against the membrane 592. The overflow holes 572 provide an outlet for the water accumulated in 546 thus preventing the accumulated water from distending the membrane or impeding the flow out of exit orifice 542. By rotating the collar 580 to the position shown in FIG. 14, the drain holes 576 are opened to prevent water accumulation in the cavity 546, thus avoiding water entrainment and producing a sharper, less diffuse impact against the membrane 592.

In use, the user 520 will position his neck against the outer front face of the membrane 592. The water stream discharged from discharge orifice 560 will impact against the membrane 592 and transfer energy therethrough to massage the user while also permitting water flow therepast to wet the user with comfortably hot tap water.

FIGS. 16–18

Attention is now directed to FIGS. 16–18 which illustrate the wall mount unit 70B. As will be seen, unit 70B is similar to aforedescribed unit 70A except that it includes a rotatable hydromassage member 600 which enables its discharge orifice 602 to travel along a circular path. More particularly, the unit 70B is comprised of a substantially cylindrical housing 620 defining a pipe inlet section 622 terminating in boss 624 defining a converging passageway 626 terminating in reduced cross section exit orifice 628. The housing 620 internally defines a cavity 630 so that water accumulated in the cavity above the level of orifice 628 will be entrained by the high velocity discharge from orifice 628, prior to entering the hydromassage member passageway 632. Hydromassage member 600 is mounted for rotation in a manner substantially identical to member 320 previously discussed in the embodiment of FIGS. 4–10. More specifically, member 600 carries an inner bearing ring 638 proximate to its rear face which rotates within a fixed bearing ring 640 supported by axially oriented fingers 642. The fingers 642 are defined by a ring member 644 which includes slots 646. The slots 646 communicate the volume within the housing 620 outside of the ring member 644 with the volume within the ring member so as to form the aforementioned cavity 630. Water accumulating in the cavity vertically above the exit orifice 628 will be entrained by the high velocity discharge at the entrance 650 to hydromassage passageway 632 which terminates at the aforementioned travelling discharge orifice 602.

The hydromassage member 600 is supported at its forward end by axial pin 652 mounted for rotation in bearing 654 held in recess 656 of hub 658 of frame 660. The frame 660 includes a rearwardly projecting skirt portion 670 which interlocks with and is secured to the housing 620 at 672. The skirt portion 670 of the frame 660 is provided with drain holes 674, analogous to the drain holes 576 discussed in connection with the embodiment of FIGS. 12–15. The skirt portion 670 carries a rotatable collar 680 which defines openings 682 which can be selectively aligned with the drain hole 674. Thus, the collar 680 can be manually operated identically to the collar 580 discussed in connection with the embodiment of FIGS. 12–15 to selectively open or close drain holes 674 to thereby either drain or accumulate water in the cavity 630. As previously mentioned, when a sufficient amount of water accumulates to rise above the exit orifice 628, the high velocity flow therefrom will entrain water from the cavity to thereby provide a discharge flow from discharge orifice 602 of lower velocity and increased mass. This discharge flow will impact against the rear face of membrane 690 to create a pleasing massage effect, as aforedescribed, with the front face of the membrane held against the user's body as shown in FIG. 35*c*. Holes 619 are provided in the housing sidewall to permit overflow from the cavity 630.

FIGS. 19–21

Figure 19:
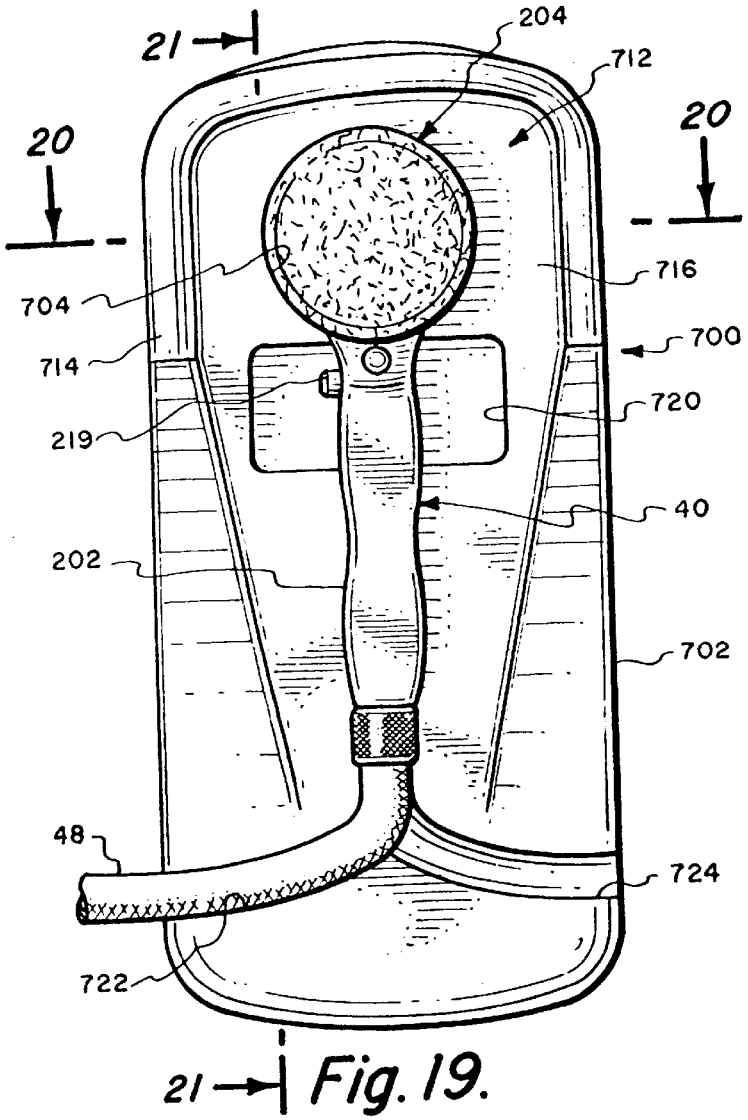
FIG. 19 is a front elevational view of a mounting structure adapted to be detachably secured to a bathtub wall for releasably accommodating the hand held water discharge apparatus of FIG. 1*a;*
Figure 20:
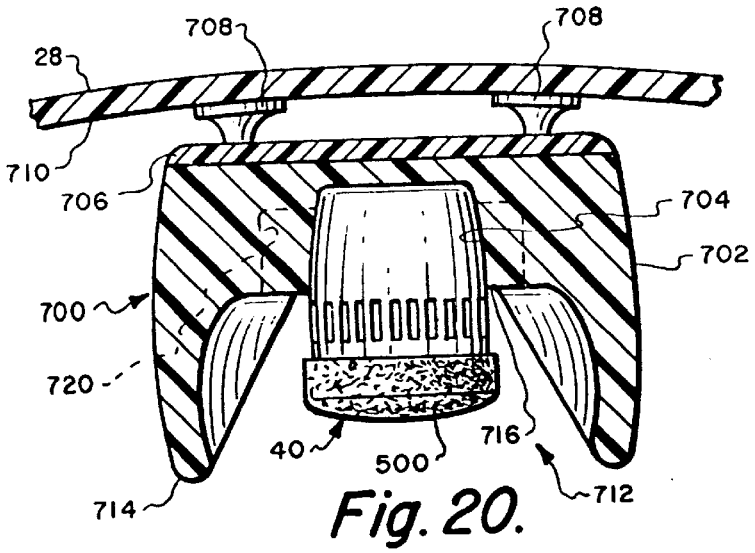
FIG. 20 is a sectional view taken substantially along the plane 20—20 of FIG. 19.
Figure 21:
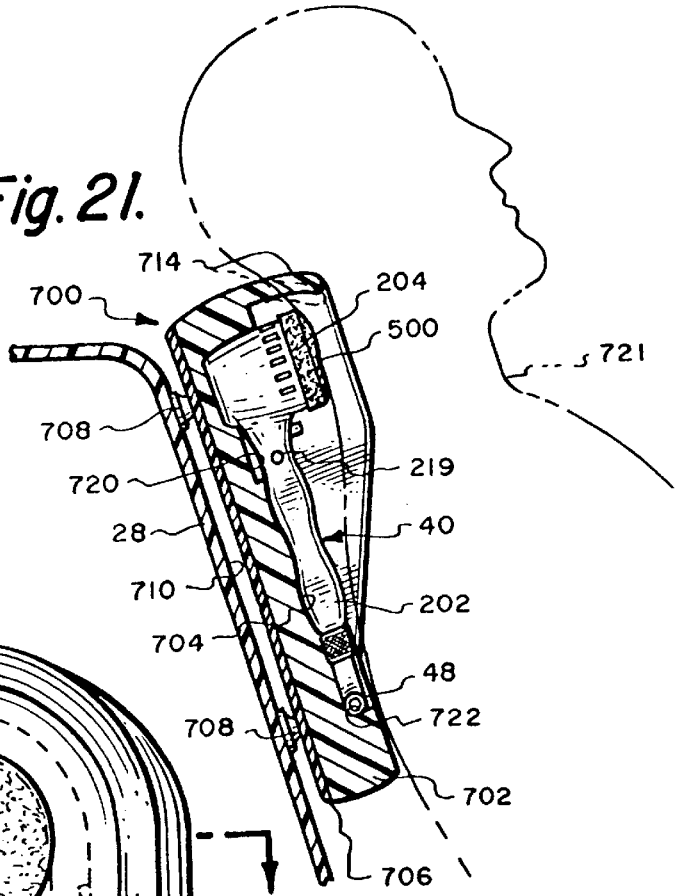
FIG. 21 is a sectional view taken substantially along the plane 21—21 of FIG. 19.

Attention is now directed to FIGS. 19–21 which illustrate a mounting structure 700 suitable for accommodating the hand held unit 40 and permitting it to function as a wall mounted unit for neck massage. More specifically, the mounting structure 700 is comprised of a flexible and resilient block 702, e.g., formed of foam rubber, defining a pocket 704 for releasably accommodating the hand held unit 40. The block 702 is securely mounted on a rigid backing panel 706. Fasteners such as suction cups 708 are secured to the panel 706 for detachably mounting the structure 700 to the inner surface 710 of bathtub wall 28.

The block 702 is preferably molded to define a large recess 712 surrounded by a peripheral lip 714. The pocket 704 for accommodating the hand held unit 40 extends rearwardly from the back wall 716 of the recess 712. An opening 720 is defined to provide user access to flow control valve 219. Recessed channels 722 and 724 extend in either direction from the pocket 704 for accommodating the supply hose 48 coupled to the handle portion 202.

In use, a user 721 will fasten the mounting structure 700 to the surface 710 of wall 28 via the suction cups 708. The hand held unit 40 will then be pushed into the pocket 704 which conforms to the profile of the handle portion 202 and head portion 204. This will locate the control valve 219 within the access opening 720. The hose 48 can then be pushed into either channel 722 or 724. With the unit 40 so accommodated, the front face of the water permeable membrane structure 500 will be located slightly to the rear of the front edge of lip 714. The user can then lean back against the lip 714, which bends readily, enabling the user to locate his neck against the front face of the membrane structure 500. The lip 714 will essentially seal against the user's skin but the water flow out of the unit 40 can readily exit into the tub via the recess 712.

FIGS. 22–24

Figure 22:
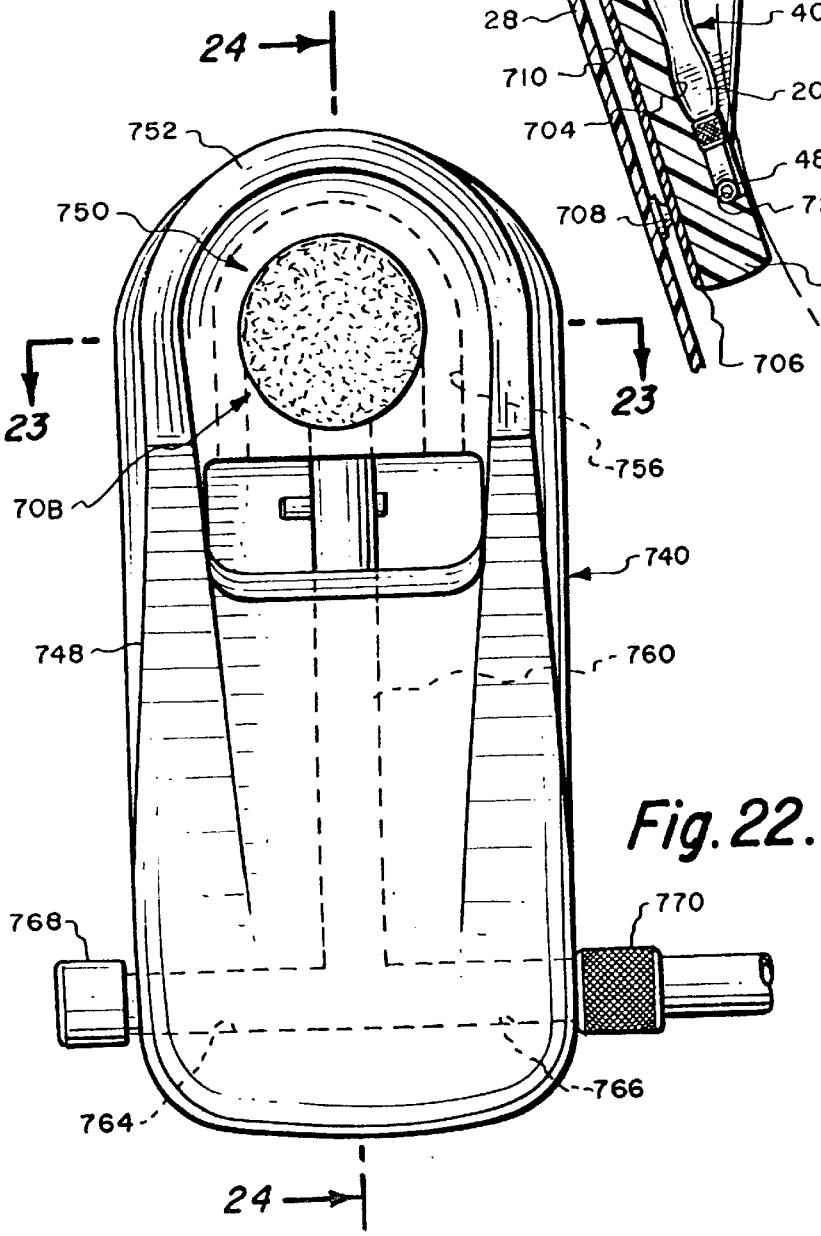
FIG. 22 is a front elevational view of an alternative mounting structure adapted to be detachably secured to a bathtub wall and incorporating a water discharge apparatus.
Figure 23:
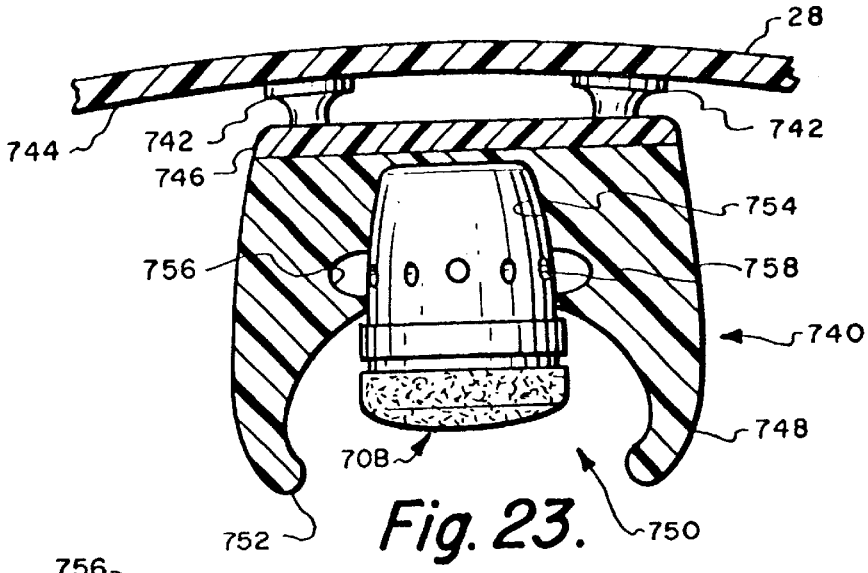
FIG. 23 is a sectional view taken substantially along the plane 23—23 of FIG. 22.
Figure 24:
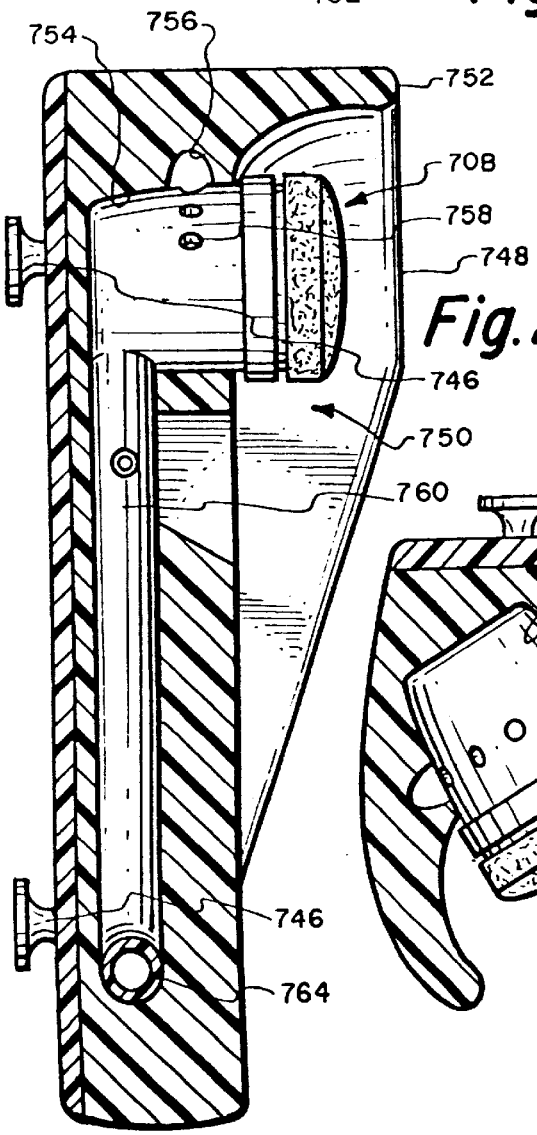
FIG. 24 is a sectional view taken substantially along the plane 24—24 of FIG. 22.

Attention is now called to FIGS. 22–24 which illustrate a further embodiment 740 of the invention, intended to be mounted by a suitable fastener, e.g., suction cups 742, on the surface 744 of bathtub wall 28. Similar to the apparatus 700 of FIGS. 19–21, the apparatus 740 includes a rigid backing panel 746 and a block 748, preferably of foam rubber, secured thereto. The block 748 defines a recess 750 surrounded by a peripheral lip 752. A pocket 754 extends rearwardly from the recess 750 for accommodating a water discharge unit, substantially identical to the unit 70B depicted in FIGS. 16–18. Note in FIG. 23 that the block 748 is internally shaped to provide an overflow channel 756 adjacent overflow holes 758. As depicted in FIG. 22, a vertical pipe stem 760 is accommodated in the block 748 and is coupled directly to the discharge apparatus 70B. Two horizontal stems 764 and 766 exit from the block 748 on opposite sides thereof, terminating in pipe couplers 768, 770.

FIG. 25

Figure 25:
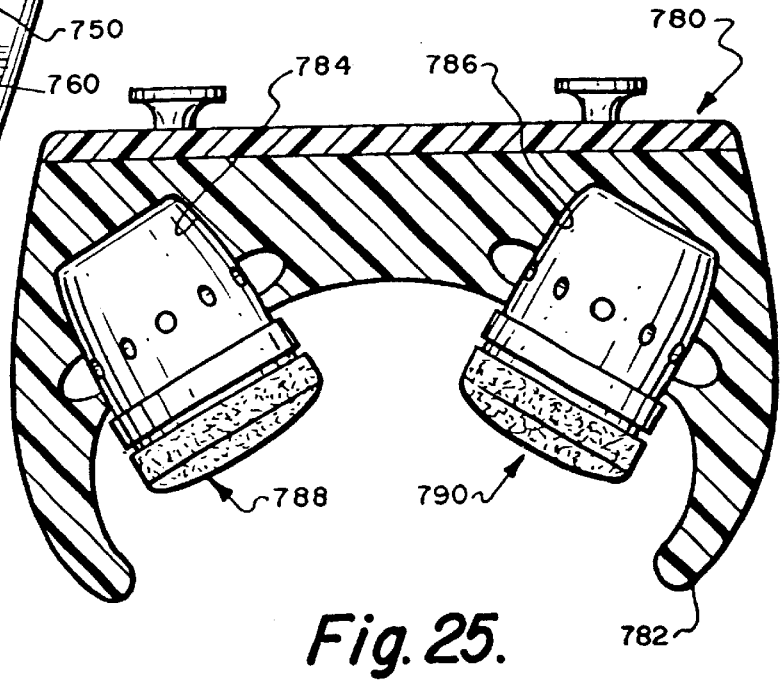
FIG. 25 is a sectional view of a mounting structure similar to that depicted in FIGS. 22–24 except, however, dimensioned to accommodate dual water discharge heads.

FIG. 25 illustrates a further embodiment 780 of the invention, quite similar to the embodiment depicted in FIGS. 22–24, except however that the block 782 is configured with dual pockets 784, 786 for respectively accommodating discharge units 788, 790. As should be apparent, the utilization of two units 788 and 790 within the single mounting structure 780 enables a user to concurrently massage both the left and right side of his neck.

FIGS. 26–33

Attention is now directed to FIGS. 26–33 which collectively illustrate a still further hand held discharge embodiment, similar in many respects to the embodiment depicted in FIGS. 4–10, but differing therefrom primarily in that (1) means are provided for mixing air into the massage stream discharged from discharge orifice 802 and (2) a selector valve 804 is incorporated in the unit's head portion 806 between the reduced cross section exit orifice 808 and hydromassage entrance 810 in lieu of the selector slide valve 222 used in the embodiment of FIGS. 4–10.

Figure 26:
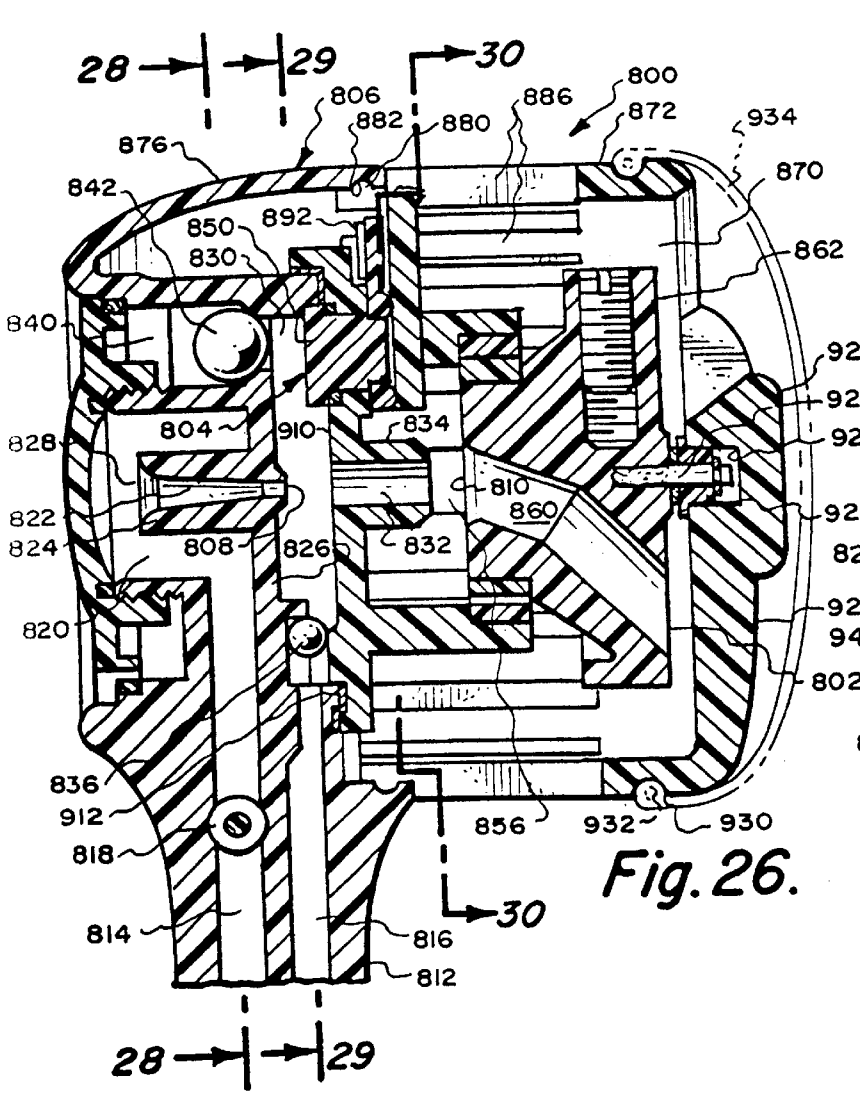
FIG. 26 is a sectional view of an alternative water discharge apparatus configured to entrain air and/or water in the hydromassage mode, the figure depicting operation in the hydromassage mode.
Figure 28:
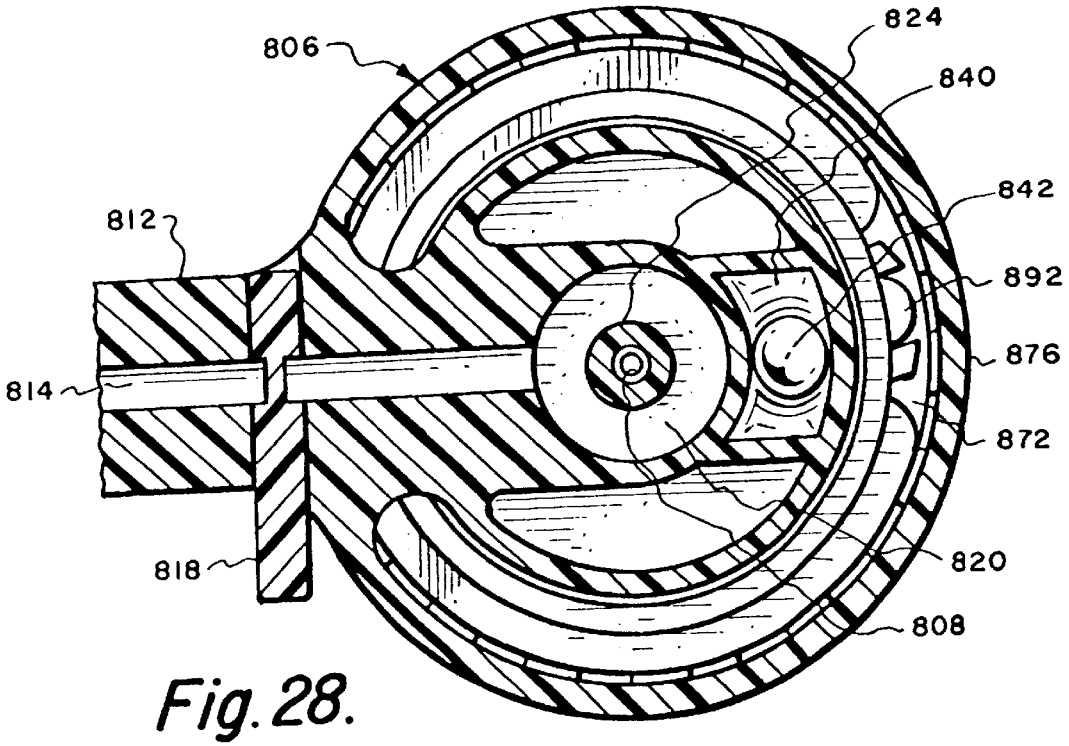
FIG. 28 is a sectional view taken substantially along the plane 28—28 of FIG. 26.

The unit 800 includes a handle portion 812 coupled to the head portion 806. The handle portion 812 includes, in addition to the water supply passageway 814, an air supply passageway 816. The water supply passageway 814 includes a slide control valve 818, substantially identical to the valve 219 discussed in the embodiment of FIGS. 4–10. Supply water flowing past the valve 818 enters chamber 820. The only outlet from chamber 820 is defined by passageway 822 formed in boss 824 extending axially through wall 826. The passageway 822 converges from a wider entrance 828 to the aforementioned reduced cross section exit orifice 808. The exit orifice 808 opens into a second chamber 830. As shown in FIG. 26, the exit orifice 808 is aligned with a short passageway 832 formed in nipple 834. The air passageway 816 also communicates with the chamber 830 via a check valve 836 which is depicted in the open (unseated) position in FIG. 26. The check valve 836 is depicted as closed (seated) in FIG. 27. The chamber 830 also communicates with a shower manifold 840 via a check valve 842. Check valve 842 is depicted as closed (seated) in FIG. 26. Check valve 842 is depicted as open (unseated) in FIG. 27. When the unit 800 is operated in the shower mode, shower check valve 842 is open and air check valve 836 is closed. When operating in the hydromassage mode, air check valve 836 is open and shower check valve 842 is closed. The aforementioned selector valve 804 is comprised of a selector valve element 850 mounted for movement between the hydromassage mode position depicted in FIG. 29 and the shower mode position depicted in FIG. 31. When in the hydromassage mode position, (FIG. 29) the reduced cross section exit orifice 808 communicates directly with the passageway 832 to discharge a high velocity flow through cavity 856 into the entrance 810 of hydromassage passageway 860 formed in hydromassage member 862. The high velocity water flow from exit orifice 808 produces a negative pressure in chamber 830 which opens check valve 836 as depicted in FIG. 26 to draw air via passageway 816, and entrain the air with the water flow as it enters passageway 832. The high velocity water air stream entering the hydromassage passageway entrance 810 can then entrain water in the cavity 856 when the unit is being operated below tub water level.

Figure 33:
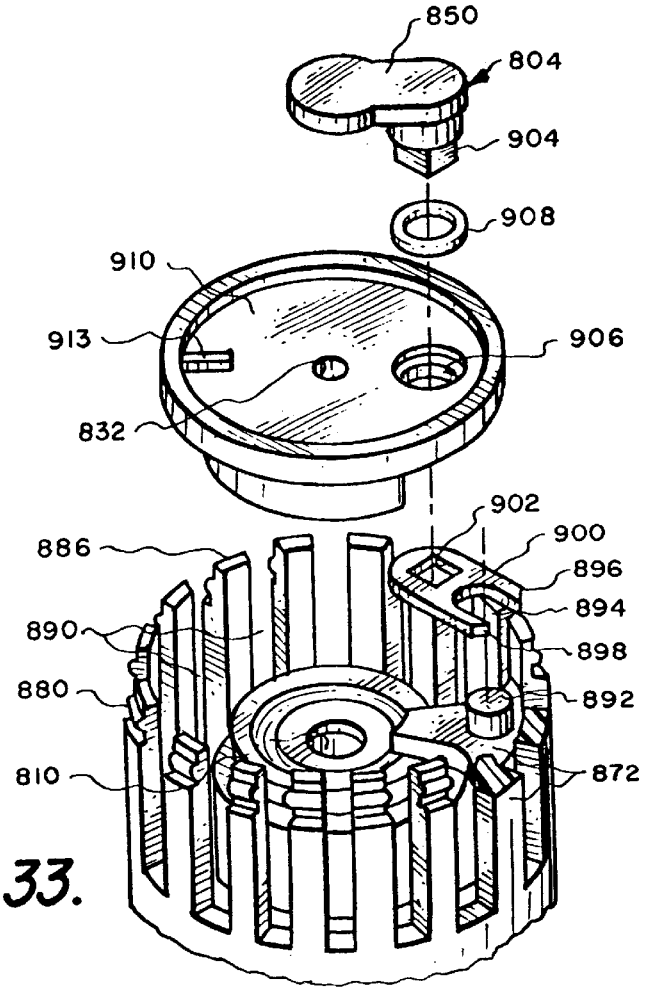
FIG. 33 is an isometric view illustrating the selector valve used in the embodiment depicted in FIGS. 26–32 for selecting either the shower mode or hydromassage mode.

The head portion 806 is formed by a forward cup-shaped housing portion 872 mounted for axial rotation relative to a rearward housing portion 876. The two housing portions are coupled for rotation at annular bead 880 formed on housing portion 872 which rotates in annular recess 882 formed in housing portion 876. The bead 880 in actuality is formed along a series of annularly arranged fingers 886 formed on the housing portion 872, as is best seen in FIG. 33. The fingers 886 are spaced by slots 890 which permit water to drain from the cavity 856.

Figure 29:
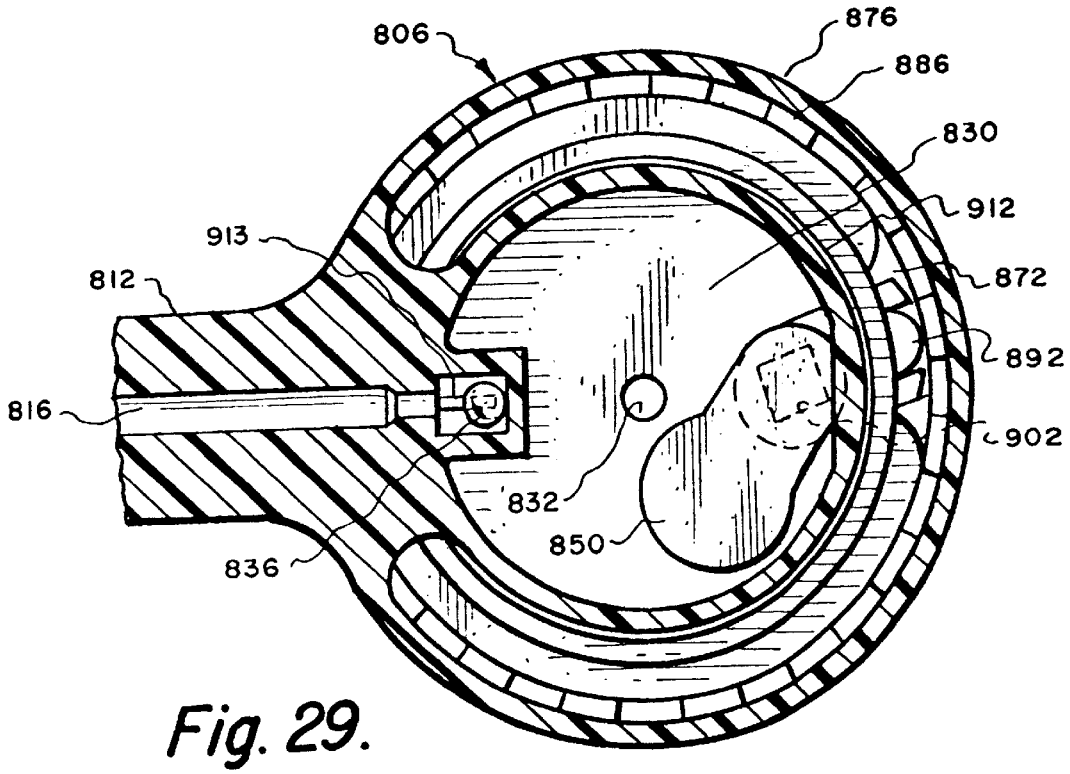
FIG. 29 is a sectional view taken substantially along the plane 29—29 of FIG. 26.
Figure 30:
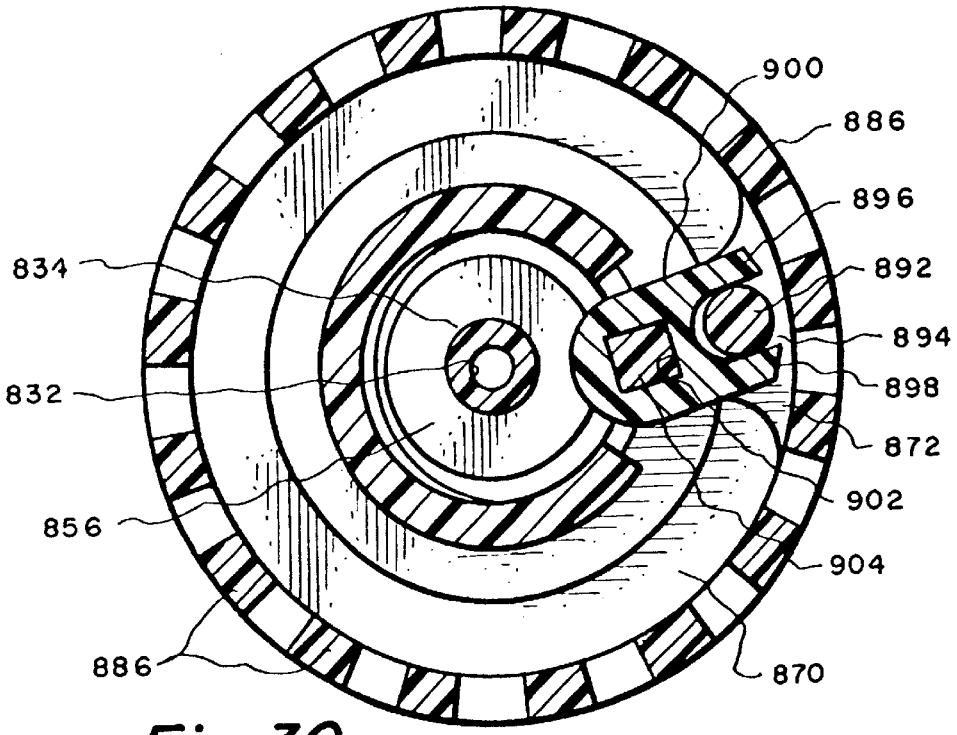
FIG. 30 is a sectional view taken substantially along the plane 30—30 of FIG. 26.
Figure 31:
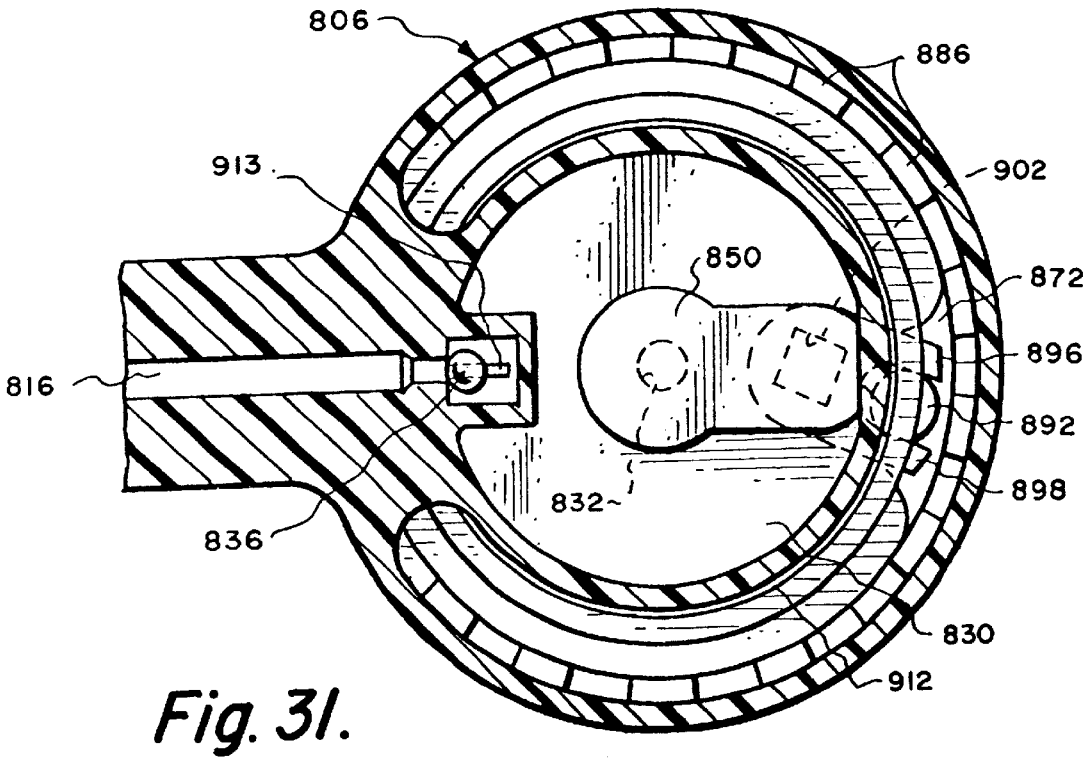
FIG. 31 is a sectional view taken substantially along the plane 31—31 of FIG. 27.
Figure 32:
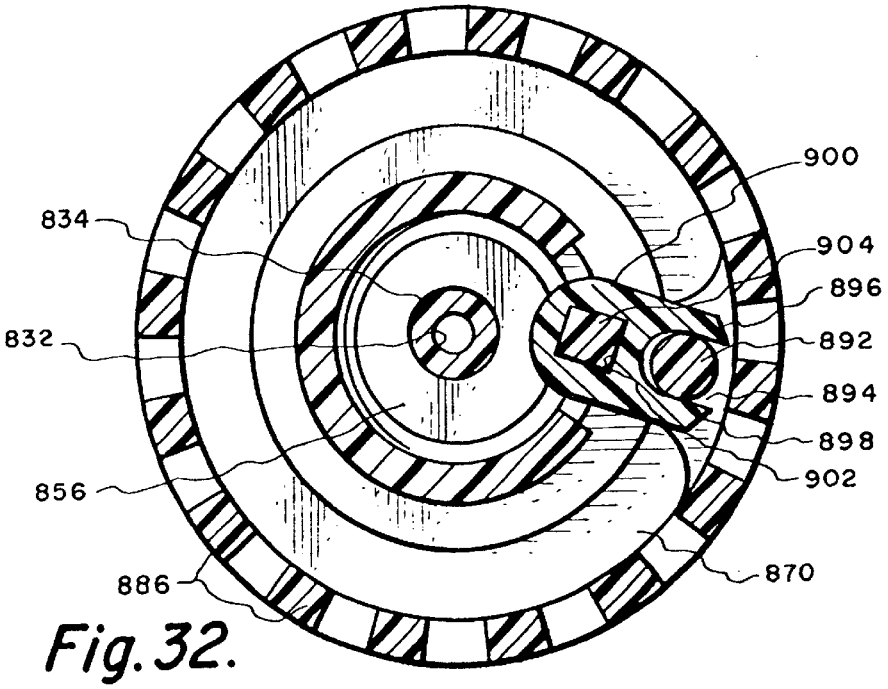
FIG. 32 is a sectional view taken substantially along the plane 32—32 of FIG. 27.

The valve element 850 is moved between the shower mode and hydromassage mode positions respectively depicted in FIGS. 31 and 29 as a consequence of relative rotation between the housing portions 872 and 876. More specifically, housing portion 872 carries a fixed stud 892 adjacent its periphery (FIGS. 30, 32). The stud extends into a recess 894 between legs 896 and 898 of a U-shaped valve actuator 900. The actuator 900 defines a square opening 902 dimensioned to receive a square shaft 904 which extends perpendicularly from the aforementioned valve element 850. As is best seen in FIG. 33, the square shaft 904 extends through a circular opening 906, sealed by O-ring 908, in disc-shaped element 910. Element 910 defines the aforementioned axial passageway 832. Disc element 910 is fixed in position relative to housing portion 876, as by gluing at 912. Radial ridge 913 functions to guide air check valve element 836.

Thus, with the position of opening 906 fixed, rotation of the housing portion 872 will move the stud between the positions represented in FIG. 30 and 32. This of course will cause the valve actuator 900 to assume either the position depicted in FIG. 30 or the position depicted in FIG. 32. The valve actuator position depicted in FIG. 30 will move the valve element 850 to the hydromassage position as shown in FIG. 29. The valve actuator position depicted in FIG. 32 will move the valve element 850 to the shower mode position depicted in FIG. 31.

In the operation of the unit 800, first assume that the flow control valve 818 is open and that the selector valve 804 is in the hydromassage position represented in FIGS. 26, 29, and 30. In this position, the high velocity flow from the exit orifice 808 will discharge through chamber 830 and passageway 832 and then through cavity 856 into the hydromassage passageway 860. The negative pressure produced in chamber 830 by the high velocity discharge will close the shower check valve 842 and open the air check valve 836. Consequently, air will be drawn from passageway 816 and will be entrained by the high velocity flow. Upon emerging from the passageway 832, this high velocity water/air stream enters the entrance 810 to hydromassage passageway 860. If the unit 800 is being operated submerged, i.e., below tub water level, then the cavity 856 will be flooded by tub water and the high velocity stream will entrain additional water from the cavity as it enters the hydromassage passageway 860. If, on the other hand, the unit 800 is being operated out of the water, then the high velocity stream will enter the hydromassage passageway 860 without water entrainment. In either case, the discharge from the discharge orifice 802 will produce a tangential force to rotate the member 860 about the axis defined by pin 920. As previously discussed in connection with the embodiment depicted in FIGS. 4—10, pin 920 is mounted for rotation in bearing 922 supported in recess 924 in the hub 926 of the front frame portion 928 of the housing portion 872. As has been previously discussed, the frame portion 928 is provided with an annular recess 930 intended to accommodate the elastic peripheral member 932 of a membrane structure 934 as described in connection with FIGS. 34, 35.

Figure 27:
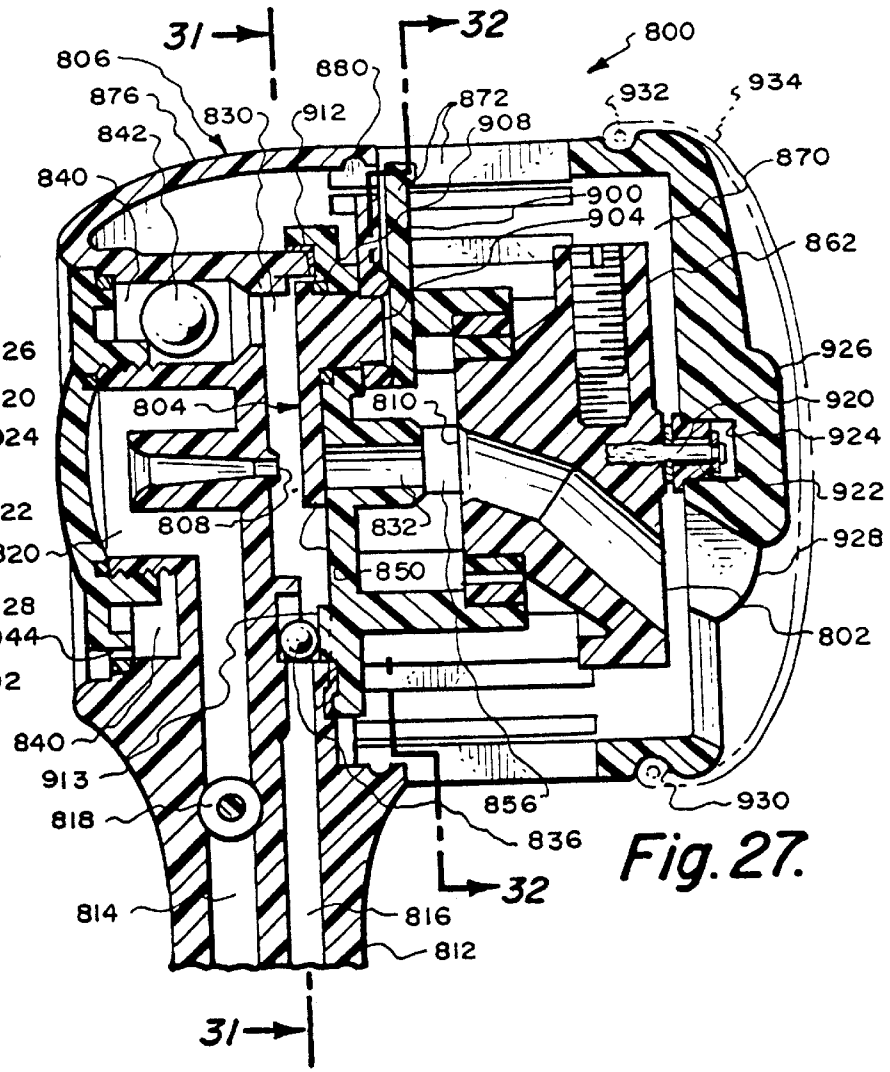
FIG. 27 is a sectional view similar to FIG. 26 except depicting operation in the shower mode.

When the housing portion 872 is rotated to move the valve actuator 900 and valve element 850 to the positions depicted in FIGS. 27, 31, and 32, the entrance to passageway 832 will be blocked. Consequently, the water flow issuing from exit orifice 808 will accumulate and produce a positive pressure in chamber 830 to thus close air check valve 836 and open shower check valve 842. The water will thus flow from chamber 830 into the shower manifold 840 from which it exits through the shower outlets defined by radial slits 944, in the manner previously described in connection with the embodiment of FIGS. 4–10.

FIGS. 34, 35

These figures depict a preferred membrane structure and have been previously discussed, primarily in connection with the embodiment of FIGS. 4–10.

FIGS. 36–41

Attention is now directed to FIGS. 36–41 which collectively illustrate a still further hand held discharge embodiment 948 similar in many respects to the embodiments respectively depicted in FIGS. 4–10 and 22–33, but differing therefrom primarily in that (1) means are incorporated for selectively providing a pulsed shower spray as well as a continuous shower spray and (2) a rotatable selector valve is incorporated in the unit's handle portion for enabling the user to select a hydromassage mode or a continuous shower mode or a pulsed shower mode.

The embodiment 948 is comprised of a handle portion 949 and a head portion 950. The handle portion 949 includes a water supply entrance 952 which opens into a chamber 953 just upstream from a selector valve 954 mounted for user rotation around screw 956. Selector valve 954 defines a single valve opening 957 which can be selectively aligned with the entrance to one of three passageways 960, 961, 962 extending longitudinally through the handle portion 949. The passageways 960, 961, 962 respectively communicate with a continuous shower spray pathway 963, a hydromassage pathway 964 and a pulsed shower spray pathway 965 in the head portion 950.

The continuous shower spray pathway 963 extends from the exit of passageway 960 to shower outlets 968 in head face 969 configured similarly to the shower outlets defined by radial slits 266 in the embodiment of FIGS. 4–10.

The hydromassage pathway 964 extends from the exit of passageway 961 to the nozzle 970 which discharges through the hydromassage passageway 971 exiting at discharge orifice 972 through head face 973, in substantially the same manner as has been described for corresponding structure in the embodiment of FIGS. 4–10.

The pulsed shower spray pathway 965 extends from the exit of passageway 962 to channel 974 which discharges through port 976 proximate to paddle wheel 978 mounted in chamber 979 for rotation around axial post 980. The paddle wheel 978 carries a plurality of radial vanes 981. The discharge port 976 is oriented to discharge a stream against the vanes 981 to rotate the paddle wheel around post 980. The paddle wheel defines one or more spaced ports 982 which periodically align with spaced pulsed shower spray outlets 984 fixedly positioned in head face 969 as the paddle wheel rotates. When the ports and outlets align, water is discharged from chamber 979 through the outlets thus producing a pulsed or interrupted shower stream.

A removeable membrane, of the type described in connection with FIGS. 34 and 35 can be mounted across the head face 973 in the manner previously described.

From the foregoing, it should now be clear that several hand held and wall mounted embodiments have been disclosed capable of responding to a pressurized water supply flow for discharging a water stream against the rear face of a limp, slack membrane configured to allow the membrane front face to engage a user's body. Embodiments of the invention may include either a traveling or fixedly mounted discharge orifice and can be configured to entrain water and/or air. Hand held and shower arm mounted embodiments are preferably capable of operating in either a continuous or pulsed shower mode or a hydromassage mode.

Although specific preferred embodiments have been described herein, it is recognized that various structural modifications and equivalents will occur to those skilled in the art and it is expressly intended that such be encompassed within the scope of the appended claims.

What is claimed is:

1. Apparatus configured for use with a source of pressurized water for massaging a user's body, said apparatus comprising:

a housing defining an open first face;

a water supply passageway extending through said housing from a water supply entrance, adapted for coupling to a pressurized water source, to a water supply exit;

a hydromassage member defining a hydromassage passageway extending from an entrance orifice to a discharge orifice, said hydromassage member being supported in said housing with said entrance orifice in communication with said water supply exit and with said discharge orifice supported for movement along a travel path and oriented to discharge a hydromassage stream toward said housing open first face;

a flexible membrane formed of limp material and having a front face and a rear face;

means attaching said membrane across said housing open first face with said membrane rear face oriented to be impacted by said hydromassage stream and said membrane front face oriented to engage a user's body;

said membrane being configured to be slack across said open first face for readily transferring the impact of said hydromassage stream against said rear face to said front face for massaging a user's body;

means for maintaining said membrane slack by preventing water accumulation against said membrane rear face sufficient to place said membrane in tension;

said housing additionally defining a second face;

at least one shower outlet supported in said housing oriented to discharge a shower spray through said second face; and valve means for selectively coupling said water supply exit to either said shower outlet or said hydromassage member entrance orifice.

2. The apparatus of claim 1 wherein said hydromassage member is supported for rotation to move said discharge orifice along a substantially circular travel path; and means for eccentrically weighting said hydromassage member to create a lateral force on said protuberance to enhance the massaging effect thereof.

3. The apparatus of claim 1 wherein said flexible membrane is water permeable.

4. Apparatus configured for use with a source of pressurized water for massaging a user's body, said apparatus comprising:

a housing defining an open first face;

a water supply passageway extending through said housing from a water supply entrance, adapted for coupling to a pressurized water source, to a water supply exit;

a hydromassage member defining a hydromassage passageway extending from an entrance orifice to a discharge orifice, said hydromassage member being supported in said housing with said entrance orifice in communication with said water supply exit and with said discharge orifice supported for movement along a travel path and oriented to discharge a hydromassage stream toward said housing open first face;

a flexible membrane formed of limp material and having a front face and a rear face;

means attaching said membrane across said housing open first face with said membrane rear face oriented to be impacted by said hydromassage stream and said membrane front face oriented to engage a user's body;

said membrane being configured to be slack across said open first face for readily transferring the impact of said hydromassage stream against said rear face to said front face for massaging a user's body;

means for maintaining said membrane slack by preventing water accumulation against said membrane rear face sufficient to place said membrane in tension;

said housing additionally defining a second face;

at least one pulsator outlet supported in said housing oriented to discharge a pulsed shower spray through said second face; and valve means for selectively coupling said water supply exit to either said pulsator outlet or said hydromassage member entrance orifice.

5. The apparatus of claim 4 further including weight means eccentrically carried by said hydromassage member for enhancing the massaging of said protuberance means.

6. Apparatus useful in combination with a water tub having a source of tap water for discharging a hydromassage stream either above or beneath the surface of a water pool in said tub, said apparatus comprising:

a housing having a water supply entrance and a water supply exit, said water supply entrance adapted to be coupled to said tap water source;

a hydromassage member having an entrance orifice communicating with said water supply exit and a discharge orifice for discharging said hydromassage stream;

a flexible membrane formed of limp material having front and rear faces, said membrane being on said housing proximate to said discharge orifice and oriented to enable said membrane rear face to be impacted by said hydromassage stream and said membrane front face to engage a user's body and wherein said membrane is configured to be slack for readily transferring the impact of said hydromassage stream against said rear face to said front face for massaging a user's body;

means for maintaining said membrane slack by preventing water accumulation against said membrane rear face sufficient to place said membrane in tension;

a shower passageway having a shower entrance port and at least one shower outlet; and user operable valve means for selectively communicating said supply exit to either said shower entrance port or said hydromassage member entrance orifice.

7. Apparatus useful in combination with a water tub having a source of tap water for discharging a hydromassage stream either above or beneath the surface of a water pool in said tub, said apparatus comprising:

a housing having a water supply entrance and a water supply exit, said water supply entrance adapted to be coupled to said tap water source;

a hydromassage member having an entrance orifice communicating with said water supply exit and a discharge orifice for discharging said hydromassage stream;

a flexible membrane formed of limp material having front and rear faces, said membrane being on said housing proximate to said discharge orifice and oriented to enable said membrane rear face to be impacted by said hydromassage stream and said membrane front face to engage a user's body and wherein said membrane is configured to be slack for readily transferring the impact of said hydromassage stream against said rear face to said front face for massaging a user's body; and means for maintaining said membrane slack by preventing water accumulation against said membrane rear face sufficient to place said membrane in tension;

said housing defining differently oriented first and second external faces; and wherein said hydromassage member discharge orifice is oriented to discharge said hydromassage stream through said first external face and said shower outlet is oriented to discharge a shower spray through said second external face.

* * * * *